US009555627B2

(12) United States Patent
Sano

(10) Patent No.: US 9,555,627 B2
(45) Date of Patent: Jan. 31, 2017

(54) LIQUID EJECTING APPARATUS

(71) Applicant: Seiko Epson Corporation, Tokyo (JP)

(72) Inventor: Takafumi Sano, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/700,492

(22) Filed: Apr. 30, 2015

(65) Prior Publication Data

US 2015/0314595 A1 Nov. 5, 2015

(30) Foreign Application Priority Data

May 2, 2014 (JP) ..... 2014-095277

(51) Int. Cl.
*B41J 2/045* (2006.01)

(52) U.S. Cl.
CPC ..... *B41J 2/04581* (2013.01); *B41J 2/0455* (2013.01); *B41J 2/0459* (2013.01); *B41J 2/04541* (2013.01); *B41J 2/04573* (2013.01); *B41J 2/04586* (2013.01); *B41J 2/04588* (2013.01); *B41J 2/04593* (2013.01)

(58) Field of Classification Search
USPC .... 347/5, 9, 11; 323/282–288; 327/108–112, 327/387–391
See application file for complete search history.

(56) References Cited

U.S. PATENT DOCUMENTS 5,526,026 A * 6/1996 Bowers ..... B41J 2/195 347/6
7,798,591 B2 * 9/2010 Ishizaki ..... B41J 2/0455 347/10
2001/0003457 A1 * 6/2001 Doi ..... B41J 2/17566 347/5
2007/0296771 A1 * 12/2007 Ou ..... B41J 2/04506 347/68
2011/0138608 A1 6/2011 Tanase et al.
2011/0234702 A1 * 9/2011 Oshima ..... H03F 3/2171 347/54
2011/0254887 A1 10/2011 Ide et al.

FOREIGN PATENT DOCUMENTS

JP 2007-168172 A 7/2007
JP 2011-121249 A 6/2011
JP 2011-224784 A 11/2011

* cited by examiner

*Primary Examiner* — Matthew Luu
*Assistant Examiner* — Lily Kemathe
(74) *Attorney, Agent, or Firm* — Harness, Dickey & Pierce, P.L.C.

(57) ABSTRACT

A liquid ejecting apparatus includes a modulation circuit that performs pulse modulation on an original signal to generate a modulated signal; a pair of transistors that generate an amplified modulated signal amplified from the modulated signal; a lowpass filter that smoothes the amplified modulated signal to generate a driving signal; an AD converter that performs AD conversion on a voltage based on the driving signal; a piezoelectric element that is displaced to eject a liquid when the driving signal is applied. The AD converter includes at least K (where K is an integer equal to or greater than 2) capacitors and a controller that causes the K capacitors to sample voltages based on the driving signal at temporally different timings, and subsequently equalizes the voltages and outputs a result of the AD conversion based on the equalized voltage.

3 Claims, 22 Drawing Sheets

<DECODING CONTENTS OF DECODER>

| PRINTING DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB $$Va=Vr-(R2/R1)\cdot(Vf-Vr)$$

<HIGH-SIDE CORRECTION MODE>

Va HIGH OR LOW DETERMINATION

VHdac CORRECTION

| | |
|---|---|
| VH00 | 2.016 V |
| VH01 | 2.014 V |
| VH02 | 2.012 V |
| VH03 | 2.010 V |
| VH04 | 2.008 V |
| VH05 | 2.006 V |
| VH06 | 2.004 V |
| VH07 | 2.002 V |
| VH08 | 2.000 V (INITIAL SET VALUE) |
| VH09 | 1.998 V |
| VH10 | 1.996 V |
| VH11 | 1.994 V |
| VH12 | 1.992 V |
| VH13 | 1.990 V |
| VH14 | 1.988 V |
| VH15 | 1.986 V |

↑ RANK HIGH

⇩ RANK LOW

<LOW-SIDE CORRECTION MODE>

Va HIGH OR LOW DETERMINATION

VLdac CORRECTION

| | |
|---|---|
| VL00 | 1.016 V |
| VL01 | 1.014 V |
| VL02 | 1.012 V |
| VL03 | 1.010 V |
| VL04 | 1.008 V |
| VL05 | 1.006 V |
| VL06 | 1.004 V |
| VL07 | 1.002 V |
| VL08 | 1.000 V (INITIAL SET VALUE) |
| VL09 | 0.998 V |
| VL10 | 0.996 V |
| VL11 | 0.994 V |
| VL12 | 0.992 V |
| VL13 | 0.990 V |
| VL14 | 0.988 V |
| VL15 | 0.986 V |

↑ RANK HIGH

↓ RANK LOW

LIQUID EJECTING APPARATUS

The entire disclosure of Japanese Patent Application No. 2014-095277, filed May 2, 2014 is expressly incorporated by reference herein.

BACKGROUND

1. Technical Field

The present invention relates to a liquid ejecting apparatus.

2. Related Art

Ink jet printers using piezoelectric elements (for example, piezo elements) as actuators are known as ink jet printers that print images or documents by ejecting ink. The piezoelectric elements are installed to correspond to a plurality of nozzles in a head unit and are each driven according to driving signals. Accordingly, predetermined amounts of ink (liquid) are ejected from the nozzles at predetermined timings to form dots.

In such printers, high productivity is necessarily realized due to high speed and high image quality. As a technology for realizing high productivity, for example, a technology for arranging a plurality of nozzles across a larger width than a target product (printing sheet) has been proposed (see JP-A-2011-121249).

When this technology is used to attempt an improvement in productivity, many nozzles and piezoelectric elements are necessary with an increase in the resolution of a target product. In order to drive the piezoelectric elements, a relatively high voltage (for example, about 40 volts) is necessary. For this reason, it is necessary to perform power amplification on driving signals using amplifiers, and then to supply the driving signals to many piezoelectric elements simultaneously and concurrently. A class D amplification circuit which is smaller in power loss and is miniaturized more easily than analog power amplification of class AB has been proposed as such an amplifier (see JP-A-2007-168172).

Specifically, the class D amplification circuit supplying driving signals to the piezoelectric elements is configured such that original signals which are sources of driving signals are pulse-modified by a modulation circuit to generate modulated signals, the modulated signals are subjected to digital amplification (class D amplification) to generate amplified modulated signals, and the amplified modulated signals are smoothed by a lowpass filter to output the amplified modulated signals as the driving signals.

A piezoelectric element is a capacitive load such as a capacitor from the viewpoint of electricity. For this reason, when the plurality of piezoelectric elements are driven, load characteristics vary according to the number of driven piezoelectric elements. Therefore, a technology for providing a plurality of feedback circuits with different frequency characteristics and selecting and switching the feedback circuits according to the number of piezoelectric elements to be driven in a configuration in which driving signals are feedback for class D amplification has been proposed (see JP-A-2011-224784).

Incidentally, in the class D amplification, there is a demand for monitoring the driving signals as in the feedback circuits. The driving signals are signals obtained by smoothing the amplified modulated signals subjected to class D amplification by a lowpass filter. However, the driving signals are not completely smoothed and ripples remain. For this reason, there is a problem in that it is difficult to accurately obtain the voltages of signals to be monitored.

SUMMARY

An advantage of some aspects of the invention is that it provides a technology for obtaining the voltages of driving signals with high accuracy even when ripples remain in the driving signals in a liquid ejecting apparatus that drive piezoelectric elements using the driving signals subjected to class D amplification to eject a liquid.

According to an aspect of the invention, there is provided a liquid ejecting apparatus including: a modulation circuit that performs pulse modulation on an original signal to generate a modulated signal; a first gate driver that generates a first gate signal according to the modulated signal; a second gate driver that generates a second gate signal different from the first gate signal according to the modulated signal; a pair of transistors that include a first transistor of which an ON or OFF state is controlled according to the first gate signal and a second transistor of which an ON or OFF state is controlled according to the second gate signal and generate an amplified modulated signal amplified from the modulated signal by controlling the ON or OFF states of the first and second transistors; a lowpass filter that smoothes the amplified modulated signal to generate a driving signal; an AD converter that performs AD conversion on a voltage based on the driving signal; a piezoelectric element that is displaced when the driving signal is applied; a cavity of which an internal volume is changed by the displacement of the piezoelectric element; and a nozzle that is installed to eject a liquid inside the cavity in response to the change in the internal volume of the cavity. The AD converter includes at least K (where K is an integer equal to or greater than 2) capacitors and a controller that causes the K capacitors to sample voltages based on the driving signal at temporally different timings, and subsequently equalizes the voltages and outputs a result of the AD conversion based on the equalized voltage.

In the liquid ejecting apparatus according to the aspect of the invention, the driving signal is generated by smoothing the amplified modulated signal and the piezoelectric element is displaced through the application of the driving signal so that the liquid is ejected from the nozzle. The driving signal is smoothed by the lowpass filter, but ripples remain. For this reason, in order to monitor the driving signal in which the ripples remain, a configuration for obtaining an average value of the driving signal sampled at a plurality of points is considered to be preferable to reduce the influence of the ripples.

According to the aspect of the invention, the AD converter causes the K capacitors to sample voltages based on the driving signal at temporally different timings, and subsequently equalizes the voltages and outputs a result of the AD conversion based on the equalized voltage. Therefore, a time until output of the average value can be shortened compared to a configuration in which the sampled results are individually subjected to the AD conversion and an average value of the data subjected to the AD conversion is obtained. Further, since the same capacity value can be used in the K capacitors, accuracy can be improved compared to a configuration in which the capacity value is weighted.

The modulated signal is a digital signal obtained by performing the pulse modulation (for example, pulse width modulation or pulse density modulation) on the original signal. In a liquid ejecting apparatus according to an aspect of the invention, a frequency component equal to or greater than 50 kHz is known to be included when the frequency spectrum of the waveform of the driving signal used to eject a small dot is analyzed. In order to generate the driving signal including the frequency component equal to or greater than 50 kHz, it is necessary to set the frequency of the modulated signal (amplified modulated signal) to be equal to or greater than 1 MHz. When the frequency of the modulated signal is set to be less than 1 MHz, the edge of the waveform of the reproduced driving signal may become dull and round. In other words, the angle becomes gentle and the waveform becomes dull. When the waveform of the driving signal becomes dull, the waveform rises and the displacement of the piezoelectric element operating according to the falling edge is slowed. Thus, tailing at the time of ejection, an ejection failure, or the like may occur, and thus printing quality may deteriorate.

On the other hand, when the frequency of the modulated signal is set to be greater than 8 MHz, the resolution of the waveform of the driving signal increases. However, since the switching frequency in the transistor increases, a switching loss becomes larger, and thus low power consumption and low heat generation which are superior properties compared to linear amplification of a class AB amplifier or the like may be impaired. Therefore, in the liquid ejecting apparatus according to the aspect of the invention, the frequency of the modulated signal is preferably equal to or greater than 1 MHz and equal to or less than 8 MHz.

The lowpass filter is generally configured to include an inductor (coil) and a capacitor, but a resistor may be added or the lowpass filter may be configured to include a resistor and a capacitor.

In the liquid ejecting apparatus according to the aspect of the invention, the controller may cause one ends of the K capacitors to sample the driving signal at the temporally different timings when each of other ends of the K capacitors is maintained at a predetermined potential, and subsequently perform the equalization by releasing the maintenance of the predetermined potential at the other end and subsequently applying a criterion voltage to each one end. Thus, charges according to the average value of the voltages of the driving signal sampled at the temporally different timings are accumulated in the K capacitors.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for realizing the invention will be described with reference to the drawings.

A printing apparatus according to the embodiment is an ink jet printer that forms an ink dot group on a printing medium such as a sheet by ejecting ink according to image data supplied from an external host computer and thus prints an image (including text and figures) according to the image data, that is, a liquid ejecting apparatus.

Figure 1:
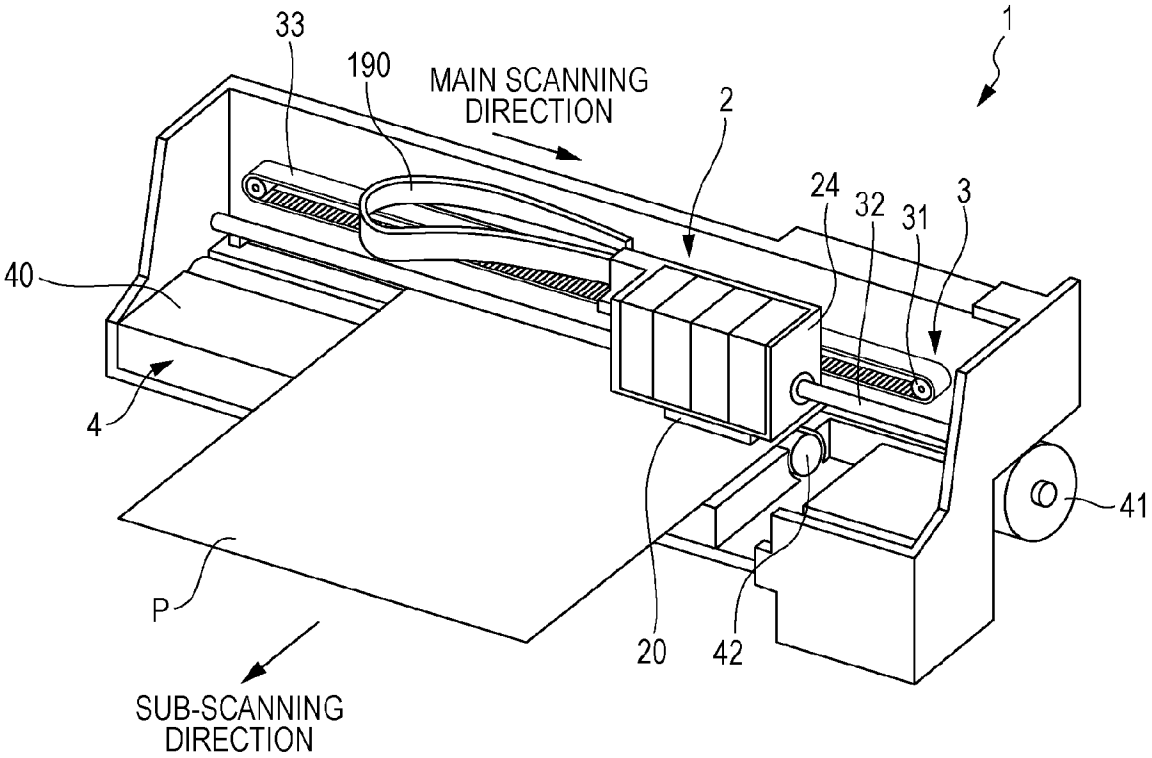
FIG. 1 is a diagram illustrating a schematic configuration of a printing apparatus.

FIG. 1 is a diagram illustrating a schematic configuration of the inside of the printing apparatus.

As illustrated in the drawing, a printing apparatus 1 includes a movement mechanism 3 that moves (reciprocates) a movement body 2 in a main scanning direction.

The movement mechanism 3 includes a carriage motor 31 which serves as a driving source of the movement body 2, a carriage guide shaft 32 of which both ends are fixed, and a timing belt 33 that extends substantially in parallel to the carriage guide shaft 32 and is driven by the carriage motor 31.

A carriage 24 of the movement body 2 is supported to reciprocate along the carriage guide shaft 32 and is fixed to a part of the timing belt 33. Therefore, when the timing belt 33 is traveled forward or backward by the carriage motor 31, the movement body 2 is guided by the carriage guide shaft 32 to reciprocate.

A head unit 20 is installed in a portion of the movement body 2 facing a printing medium P. As will be described below, the head unit 20 is a unit that ejects ink droplets (liquid droplets) from a plurality of nozzles and is configured to be supplied with various control signals or the like via a flexible cable 190.

The printing apparatus 1 includes a transport mechanism 4 that transports the printing medium P in a sub-scanning direction on a platen 40. The transport mechanism includes a transport motor 41 that serves as a driving source and a transport roller 42 that is rotated by the transport motor 41 to transport the printing medium P in the sub-scanning direction.

The head unit 20 ejects the ink droplets to the printing medium P at a timing at which the printing medium P is transported by the transport mechanism 4, so that an image is formed on the surface of the printing medium P.

Figure 2:
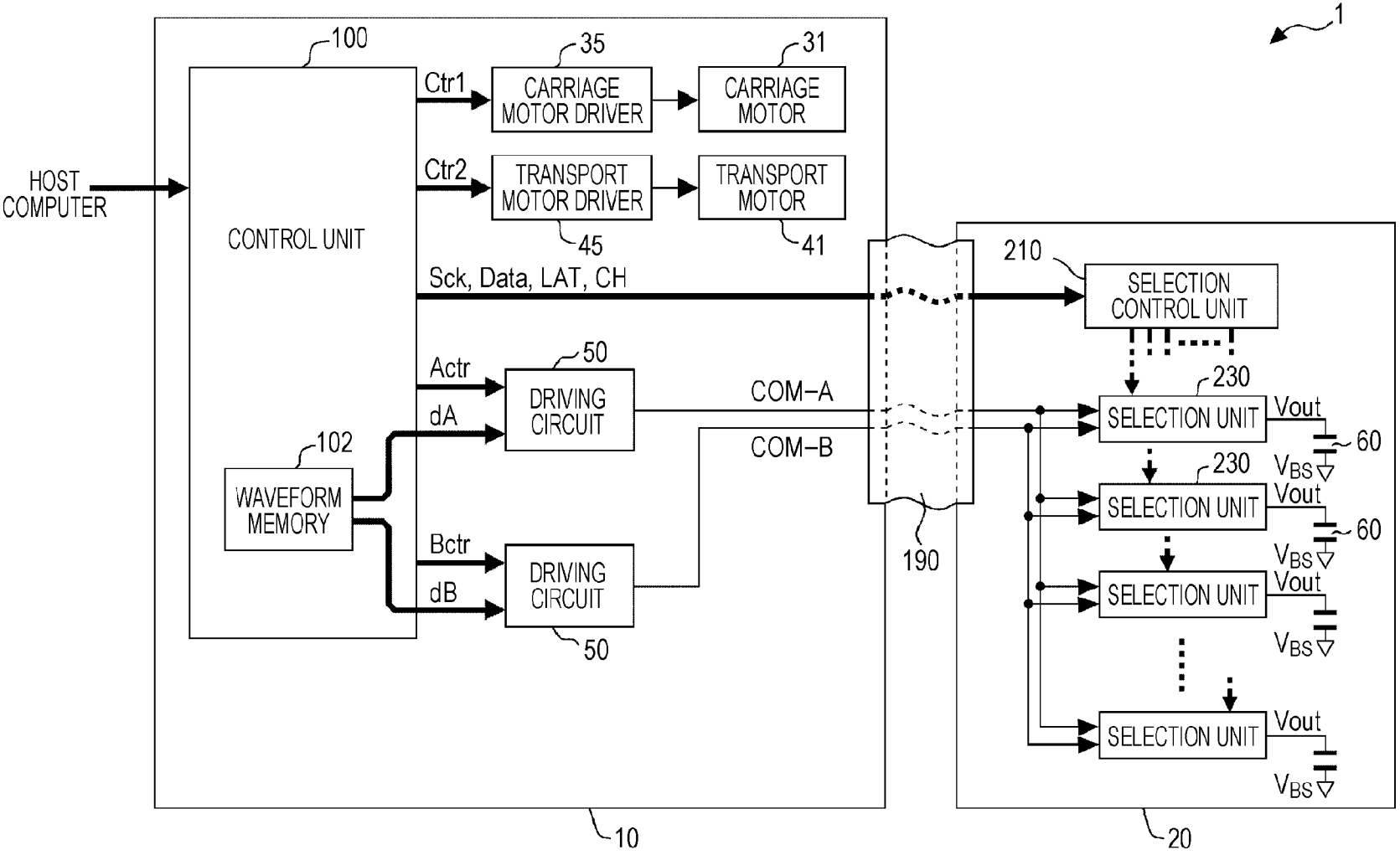
FIG. 2 is a block diagram illustrating the configuration of the printing apparatus.

FIG. 2 is a block diagram illustrating an electric configuration of the printing apparatus 1.

In the printing apparatus 1, as illustrated in the drawing, the control unit 10 and the head unit 20 are connected to each other through the flexible cable 190.

The control unit 10 includes a control unit 100, the carriage motor 31, a carriage motor driver 35, a transport motor 41, a transport motor driver 45, and two driving circuits 50.

Of these unit, the control unit 100 outputs various control signals or the like to control each unit as follows when image data is supplied from the host computer.

Specifically, first, the control unit 100 supplies a control signal Ctr1 to the carriage motor driver 35. Therefore, since the carriage motor driver 35 drives the carriage motor 31 according to the control signal Ctr1, movement in the main scanning direction in the carriage 24 is controlled.

Second, the control unit 100 supplies a control signal Ctr2 to the transport motor driver 45. Therefore, since the transport motor driver 45 drives the transport motor 41 according to the control signal Ctr2, movement in the sub-scanning direction by the transport mechanism 4 is controlled.

Third, the control unit 100 supplies digital control data Actr and digital waveform data dA to one of the two driving circuits 50 and supplies digital control data Bctr and digital waveform data dB to the other of the two driving circuits 50.

Here, the control data Actr and the control data Bctr are signals that define an operation mode. As the operation mode is described below in detail, there are three kinds of operation modes in the embodiment. That is, there are a sleep mode in which part of power is stopped for power saving, a correction mode in which an internal voltage of the driving circuit 50 is corrected, and an ejection mode in which printing is performed to eject ink.

The waveform data dA defines a voltage at each of the points divided along a time axis with 10 bits in regard to a driving signal COM-A (trapezoid waveform) among the driving signals supplied to the head unit 20. Likewise, the waveform data dB defines a voltage at each of the points divided along the time axis with 10 bits in regard to a driving signal COM-B. Both of the waveform data dA and waveform data dB are configured such that data stored in the waveform memory 102 is repeatedly read and supplied. The details of the waveforms of the driving signals COM-A and COM-B will be described below.

As the details of the driving circuit 50 is described below, one of the driving circuits 50 performs analog conversion on the data dA, and then supplies the driving signal COM-A subjected to class D amplification to the head unit 20. Likewise, the other driving circuit 50 performs analog conversion on the data dB, and then supplies the driving signal COM-B subjected to class D amplification to the head unit 20.

Fourth, the control unit 100 supplies a clock signal Sck, a data signal Data, and control signals LAT and CH to the head unit 20.

The head unit 20 includes a selection control unit 210 and a plurality of pairs of selection units 230 and piezoelectric elements (piezo elements) 60.

The selection control unit 210 instructs each of the selection units 230 to select any driving signal between the driving signals COM-A and COM-B in the ejection mode (or select neither of the driving signals), using a control signal or the like supplied from the control unit 100. Then, the selection unit 230 selects the driving signal COM-A or COM-B according to the instruction from the selection control unit 210 and supplies the selected driving signal to one end of the piezoelectric element 60 (or selects neither of the driving signals).

In the drawing, a voltage of the driving signal output from the selection unit 230 is denoted by Vout. The selection control unit 210 instructs each of the selection units 230 to select neither of the driving signals COM-A and COM-B in the sleep mode and the correction mode. Thus, the control signal is not illustrated.

On the other hand, a voltage $V_{BS}$ is commonly applied to the other ends of the piezoelectric elements 60 in this example.

The piezoelectric elements 60 are installed to correspond to the plurality of nozzles in the head unit 20, respectively. The piezoelectric element 60 is displaced according to a difference between a voltage Vout and the voltage $V_{BS}$ of the driving signal selected by the selection unit 230 to eject the ink. Accordingly, next, a configuration for ejecting the ink through driving in the piezoelectric elements 60 will be described in brief.

Figure 3:
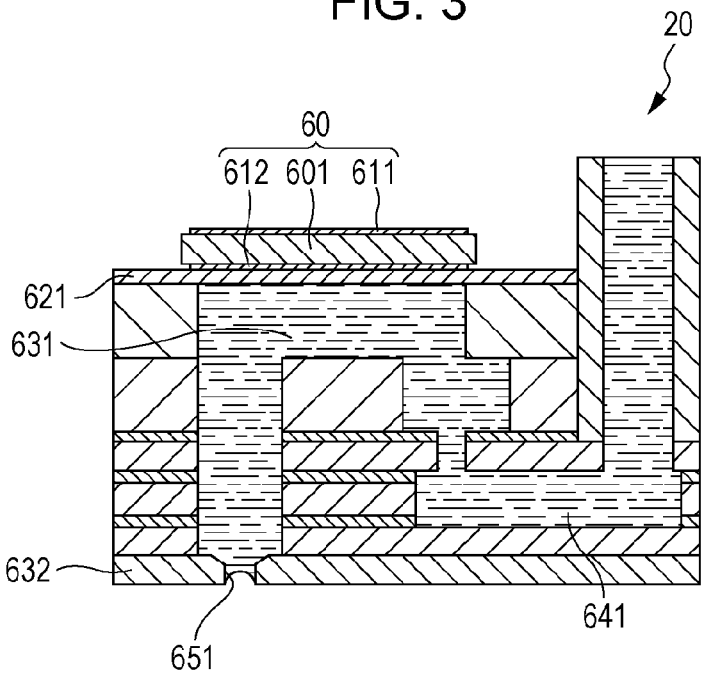
FIG. 3 is a diagram illustrating the configuration of an ejecting unit in a head unit.

FIG. 3 is a diagram illustrating a schematic configuration corresponding to one nozzle in the head unit 20.

As illustrated in the drawing, the head unit 20 includes the piezoelectric element 60, a vibration plate 621, a cavity (pressure chamber) 631, a reservoir 641, and a nozzle 651. Of the constituents, the vibration plate 621 functions as a diaphragm that expands and contracts the internal volume of the cavity 631 filled with ink by being displaced (bending vibration) by the piezoelectric element 60 installed on an upper surface in the drawing. The nozzle 651 is installed in a nozzle plate 632 and is an opening portion communicating with the cavity 631.

The piezoelectric element 60 illustrated in the drawing has a structure in which a piezoelectric substance 601 is interposed between a pair of electrodes 611 and 612. A middle portion of the piezoelectric substance 601 in the structure in the drawing is bent vertically with respect to both end portions along with the electrodes 611 and 612 and the vibration plate 621 according to a voltage applied by the electrodes 611 and 612. Specifically, the piezoelectric element 60 is configured to be bent upward when the voltage Vout of the driving signal increases whereas being bent downward when the voltage Vout decreases. When the piezoelectric element 60 is bent upward in this configuration, the internal volume of the cavity 631 expands, and thus the ink is drawn into from the reservoir 641. Conversely, when the piezoelectric element 60 is bent downward, the internal volume of the cavity 631 contracts, and thus the ink is ejected from the nozzle 651 according to the degree of contraction.

The piezoelectric element 60 is not limited to the illustrated structure, but may be a type of piezoelectric element 60 that can eject a liquid such as ink by being deformed. The piezoelectric element 60 is not limited to the bending vibration, but may be configured using vertical vibration.

The piezoelectric element 60 is installed to correspond to the cavity 631 and the nozzle 651 in the head unit 20 and the piezoelectric element 60 is installed to also correspond to the selection unit 230 in FIG. 2. Therefore, a set of the piezoelectric element 60, the cavity 631, the nozzle 651, and the selection unit 230 is installed for each nozzle 651.

Figure 4A:
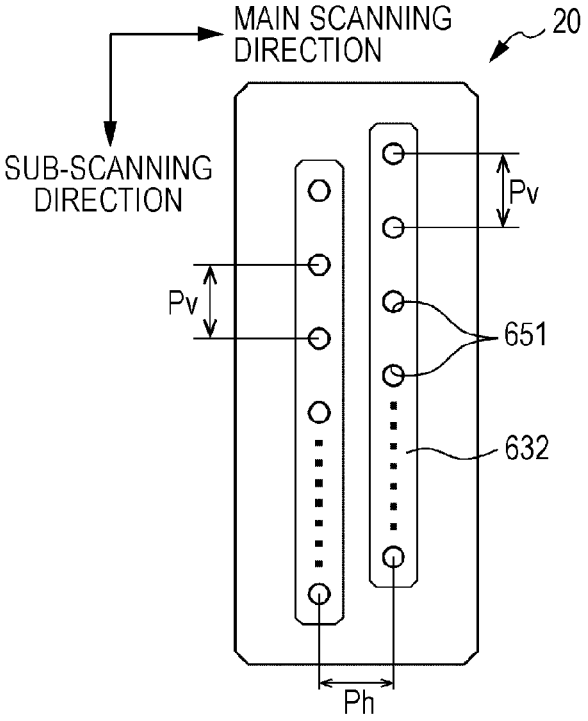
FIGS. 4A and 4B are diagrams illustrating nozzle arrangement in the head unit.

FIG. 4A is a diagram illustrating an example of the arrangement of the nozzles 651.

As illustrated in the drawing, the nozzles 651 are arranged in, for example, two rows. Specifically, in view of one row, the plurality of nozzles 651 are disposed at a pitch Pv in the sub-scanning direction. On the other hand, the two rows have a relation in which the rows are separated by a pitch Ph in the main scanning direction and are shifted by half of the pitch Pv in the sub-scanning direction.

When color printing is performed, a pattern of the nozzles 651 corresponding to colors such as cyan (C), magenta (M), yellow (Y), and black (K) are installed, for example, in the main scanning direction. However, to facilitate the following description, a case in which gray scales are expressed in monochrome will be described.

Figure 4B:
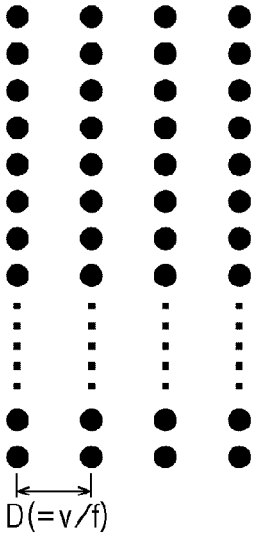

FIG. 4B is a diagram for describing a basic resolution for image forming in the arrangement of the nozzles illustrated in FIG. 4A in the ejection mode. To facilitate the description, the drawing illustrates black-painted circles as dots formed by landing ink droplets in an example of a method (first method) of forming one dot by ejecting the ink droplet once from each nozzle 651.

When the head unit 20 moves in the main scanning direction at a speed V, as illustrated in the drawing, the speed V and an interval D of the dots (in the main scanning direction) formed by landing the ink droplets have the following relation.

That is, when one dot is formed by ejecting the one-time ink droplet once, the dot interval D is indicated by a value (=v/f) obtained by dividing the speed V by an ink ejection frequency f, in other words, a distance by which the head unit 20 moves at a period (1/f) at which the ink droplet is repeatedly ejected.

In the examples of FIGS. 4A and 4B, the pitch Ph has a relation proportional to the dot interval D with a coefficient n and the ink droplets ejected from the nozzles 651 in the two rows are landed to be arranged in the same rows on the printing medium P. Therefore, as illustrated in FIG. 4B, the dot interval in the sub-scanning direction is the half of the dot interval in the main scanning direction. The arrangement of the dots is, of course, not limited to the illustrated example.

Incidentally, in order to realize high-speed printing in the ejection mode, the speed V at which the head unit 20 moves in the main scanning direction may be increased simply. However, when on the speed V is increased, the dot interval D becomes longer. Therefore, while a certain degree of resolution is ensured, it is necessary to increase the number of dots formed per unit time by increasing the ink ejection frequency f in order to realize the high-speed printing.

In order to increase a resolution apart from a printing speed, the number of dots formed per unit area may be increased. However, when the number of dots is increased, not only may mutually adjacent dots be joined if the amount of ink is not small, but also the printing speed may be lowered if the ink ejection frequency f is not high.

Thus, in order to realize high-speed printing and high-resolution printing, it is necessary to increase the ink ejection frequency f.

On the other hand, the method of forming dots on the printing medium P includes not only the method of forming one dot by ejecting an ink droplet once but also a method (second method) of forming one dot by landing one or more ink droplets ejected per unit time and joining the one or more landed ink droplets or a method (third method) of forming two or more dots without joining the two or more ink droplets, as a method of capable of ejecting ink droplets two or more times per unit time. In the following description, a case in which dots are formed according to the second method will be described.

In the embodiment, the second method will be made assuming the following example. That is, in the embodiment, four gray scales of a large dot, a middle dot, a small dot, and non-recording are expressed for one dot by ejecting ink up to twice. In order to express the four gray scales, in the embodiment, two kinds of driving signals COM-A and COM-B are prepared, and one period has a first-half pattern and a second-half pattern for each signal. The driving signal COM-A or COM-B is configured to be selected (or not selected) in the first half and the second half of one period according to a gray scale to be expressed and to be supplied to the piezoelectric element 60.

Accordingly, the driving signals COM-A and COM-B in the ejection mode will be described, and then a configuration for selecting the driving signal COM-A or COM-B will be described. The driving signals COM-A and COM-B are generated by the respective driving circuits 50. The driving circuits 50 will be described after the configuration for selecting the driving signal COM-A or COM-B for convenience.

Figure 5:
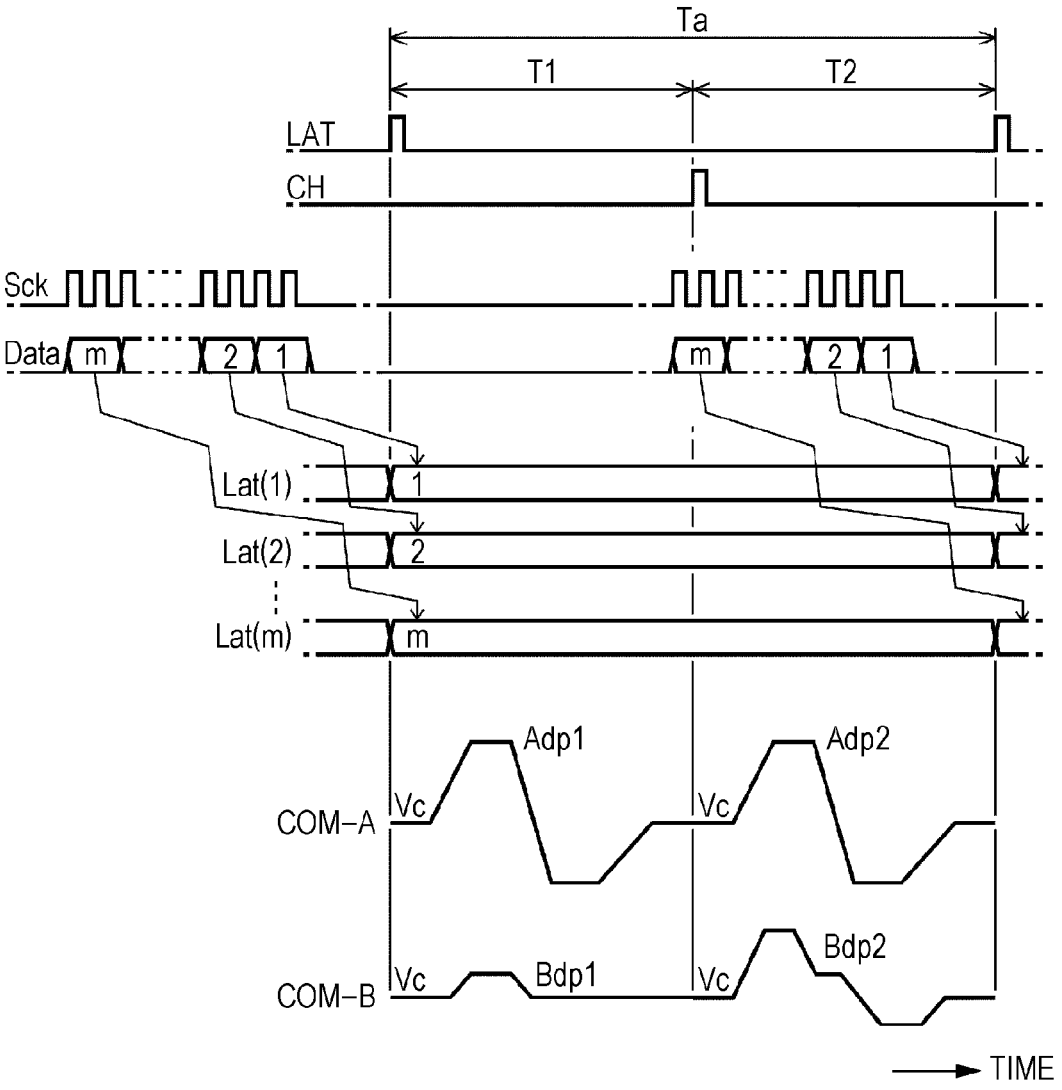
FIG. 5 is a diagram for describing an operation of a selection control unit in the head unit.

FIG. 5 is a diagram illustrating the waveforms of the driving signals COM-A and COM-B and the like in the ejection mode. As illustrated in the drawing, the driving signal COM-A in the ejection mode has a continuous waveform of a trapezoid waveform Adp1 disposed in a period T1 in which the control signal LAT is output (rises) and the control signal CH is output in a printing period Ta and a trapezoid waveform Adp2 disposed in a period T2 in which the control signal CH is output and the subsequent control signal LAT is output in the printing period Ta. In the ejection mode, the trapezoid waveforms Adp1 and Adp2 are repeated.

In the embodiment, the trapezoid waveforms Adp1 and Adp2 are substantially the same waveform and are waveforms for ejecting a predetermined amount of ink, specifically, a middle amount of ink from the nozzle 651 corresponding to the piezoelectric element 60 when the trapezoid waveforms Adp1 and Adp2 are each supplied to one end of this piezoelectric element 60.

The driving signal COM-B in the ejection mode has continuous waveforms of a trapezoid waveform Bdp1 disposed in the period T1 and a trapezoid waveform Bdp2 disposed in the period T2. In the ejection mode, the trapezoid waveforms Adp1 and Adp2 are repeated. In the embodiment, the trapezoid waveforms Bdp1 and Bdp2 are different waveforms. Of the trapezoid waveforms, the trapezoid waveform Bdp1 is a waveform for preventing the viscosity of the ink from increasing by minutely vibrating the ink near the opening portion of the nozzle 651. Therefore, even when the trapezoid waveform Bdp1 is supplied to one end of the piezoelectric element 60, no ink droplet is ejected from the nozzle 651 corresponding to this piezoelectric element 60. The trapezoid waveform Bdp2 is a waveform different from the trapezoid waveform Adp1 (Adp2). The trapezoid waveform Bdp2 is a waveform for ejecting the amount of ink less than the predetermined amount from the nozzle 651 corresponding to the piezoelectric elements 60 even when the trapezoid waveform Bdp2 is supplied to one end of this piezoelectric element 60.

All of the voltages at start timings and end timings of the trapezoid waveforms Adp1, Adp2, Bdp1, and Bdp2 are commonly a voltage Vc. That is, the trapezoid waveforms Adp1, Adp2, Bdp1, and Bdp2 are waveforms starting at the voltage Vc and ending at the voltage Vc.

Figures 6, 7:
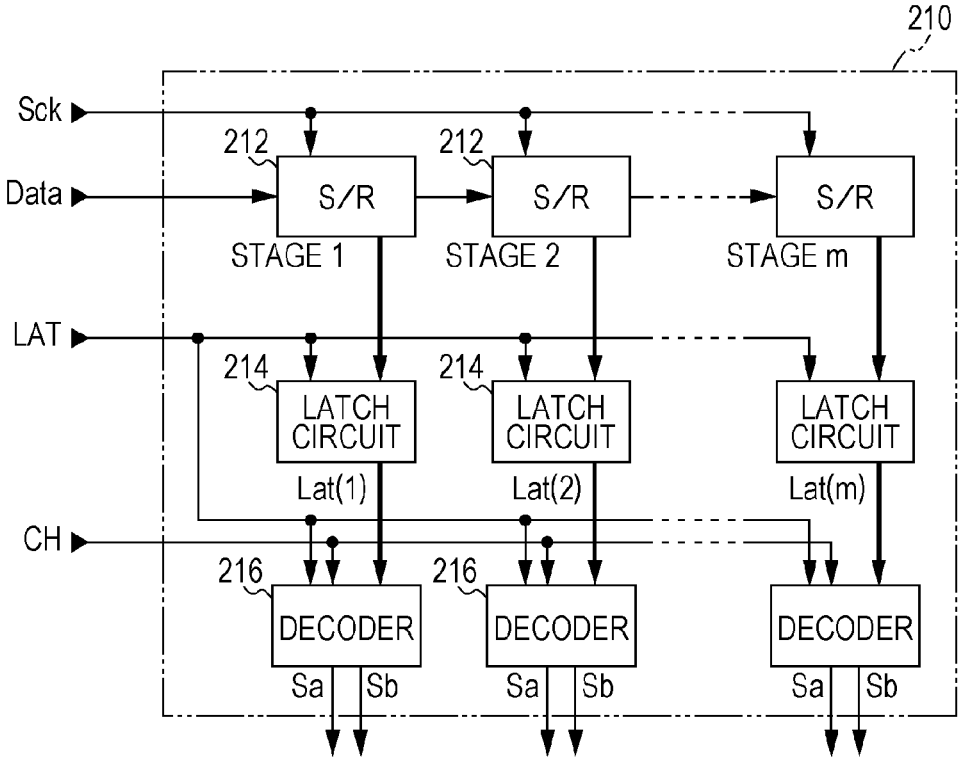
FIG. 6 is a diagram illustrating the configuration of the selection control unit in the head unit.
FIG. 7 is a diagram illustrating decoding contents of a decoder in the head unit.

FIG. 6 is a diagram illustrating the configuration of the selection control unit 210 in FIG. 2.

As illustrated in the drawing, the control unit 10 supplies the selection control unit 210 with the clock signal Sck, the data signal Data, and the control signals LAT and CH. In the selection control unit 210, a set of a shift register (S/R) 212, a latch circuit 214, and a decoder 216 are installed to correspond to each piezoelectric element 60 (nozzle 651).

The data signal Data defines the size of one dot when the dot of an image is formed. In the embodiment, the data signal Data has 2 bits of the most significant bit (MSB) and the least significant bit (LSB) in order to express four gray scales of non-recording, a small dot, a middle dot, and a large dot.

The data signal Data is supplied serially from the control unit 100 in tune with main scanning of the head unit 20 for each nozzle in synchronization with the clock signal Sck. The shift register 212 has a configuration in which the serially supplied data signal Data is temporarily retained by 2 bits to correspond to nozzle.

Specifically, the shift registers 212 of the number of stages corresponding to the piezoelectric element 60 (the nozzles) are cascade-connected to each other and the serially supplied data signals Data are configured to be transmitted sequentially to the rear stage according to the clock signal Sck.

When m (m is plural) is the number of piezoelectric elements 60, stage 1, stage 2, . . . , and stage m are notated sequentially from the upper stream side from which the data signal Data is supplied in order to distinguish the shift registers 212 from each other.

The latch circuit 214 latches the data signal Data retained in the shift register 212 at the rise of the control signal LAT.

The decoder 216 decodes the 2-bit data signal Data latched by the latch circuit 214, outputs selection signals Sa and Sb for each period T1 and each period T2 defined by the control signal LAT and the control signal CH, and defines the selection in the selection unit 230.

FIG. 7 is a diagram illustrating decoding contents in the decoder 216.

In the drawing, (MSB, LSB) are notated for the latched 2-bit data signal Data. For example, when the latched data signal Data is (0, 1), this data signal Data means that the decoder 216 sets logic levels of the selection signals Sa and Sb to H and L levels, respectively in the period T1 and sets the logic levels of the selection signals Sa and Sb to L and H levels, respectively, in the period T2.

The logic levels of the selection signals Sa and Sb are subjected to level shift to be set to higher amplitude levels by a level shifter (not illustrated) than the logic levels of the clock signal Sck, the printing data Data, and the control signals LAT and CH.

Figure 8:
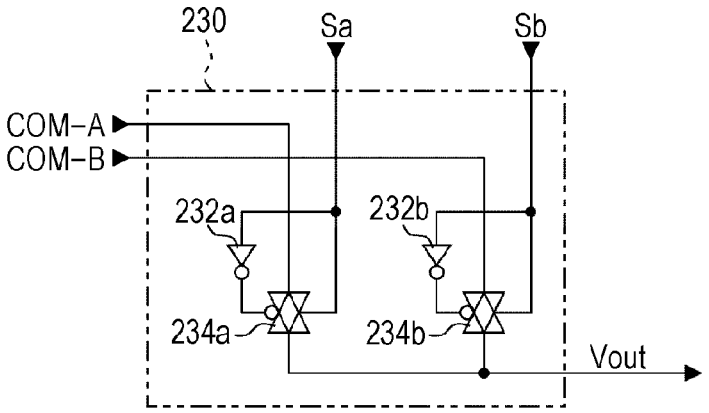
FIG. 8 is a diagram illustrating the configuration of a selection unit in the head unit.

FIG. 8 is a diagram illustrating the selection unit 230 corresponding to one piezoelectric element 60 (nozzle 651) in FIG. 2.

As illustrated in the drawing, the selection unit 230 includes inverters (NOT circuits) 232*a* and 232*b* and transfer gates 234*a* and 234*b*.

The selection signal Sa from the decoder 216 is supplied to a positive control end with no circle mark in the transfer gate 234*a*. On the other hand, the selection signal Sa is subjected to logic inversion by the inverter 232*a* and is supplied to a negative control end with a circle mark in the transfer gate 234*a*. Likewise, the selection signal Sb is supplied to a positive control end of the transfer gate 234*b*. On the other hand, the selection signal Sb is subjected to logic conversion by the inverter 232*b* and is supplied to a negative control end of the transfer gate 234*b*.

The driving signal COM-A is supplied to an input end of the transfer gate 234*a* and the driving signal COM-B is supplied to an input end of the transfer gate 234*b*. Output ends of the transfer gates 234*a* and 234*b* are commonly connected and are connected to one end of the corresponding piezoelectric element 60.

When the selection signal Sa is in the H level, the transfer gate 234*a* electrifies (turns on) the input end and the output end. When the selection signal Sa is in the L level, the transfer gate 234*a* not electrify (turns off) the input end and the output end. Likewise, the transfer gate 234*b* turns on and off the input end and the output end according to the selection signal Sb.

Next, an operations of the selection control unit 210 and the selection unit 230 will be described with reference to FIG. 5.

The data signal Data is supplied serially from the control unit 100 for each nozzle in synchronization with the clock signal Sck and is transmitted sequentially to the shift registers 212 corresponding to the nozzles. When the control unit 100 stops supplying the clock signal Sck, each of the shift registers 212 enters a state in which the data signal Data corresponding to the nozzle is retained. The data signal Data is supplied in order corresponding to the nozzles of the final stage m, . . . , stage 2, and stage 1 of the shift registers 212.

Here, when the control signal LAT rises, the latch circuits 214 simultaneously latch the data signal Data retained in the shift registers 212. In FIG. 5, Lat(1), Lat(2), . . . , and Lat(m) indicate the data signals Data latched by the latch circuits 214 corresponding to the shift registers 212 at stage 1, stage 2, . . . , and stage m.

The decoder 216 outputs the logic levels of the selection signals Sa and Sb, as shown in the contents illustrated in FIG. 7, in the periods T1 and T2 according to the sizes of the dots defined by the latched data signals Data.

That is, first, when the data signal Data is (1, 1) and defines the size of a large dot, the decoder 216 sets the selection signals Sa and Sb to the H and L levels, respectively, in the period T1 and also sets the selection signals Sa and Sb to the H and L levels, respectively, in the period T2. Second, when the data signal Data is (0, 1) and defines the size of a middle dot, the decoder 216 sets the selection signals Sa and Sb to the H and L levels, respectively, in the period T1 and also sets the selection signals Sa and Sb to the L and H levels, respectively, in the period T2. Third, when the data signal Data is (1, 0) and defines the size of a small dot, the decoder 216 sets the selection signals Sa and Sb to the L and L levels, respectively, in the period T1 and also sets the selection signals Sa and Sb to the L and H levels, respectively, in the period T2. Fourth, when the data signal Data is (0, 0) and defines non-recording, the decoder 216 sets the selection signals Sa and Sb to the L and H levels, respectively, in the period T1 and also sets the selection signals Sa and Sb to the L and L levels, respectively, in the period T2.

Figure 9:
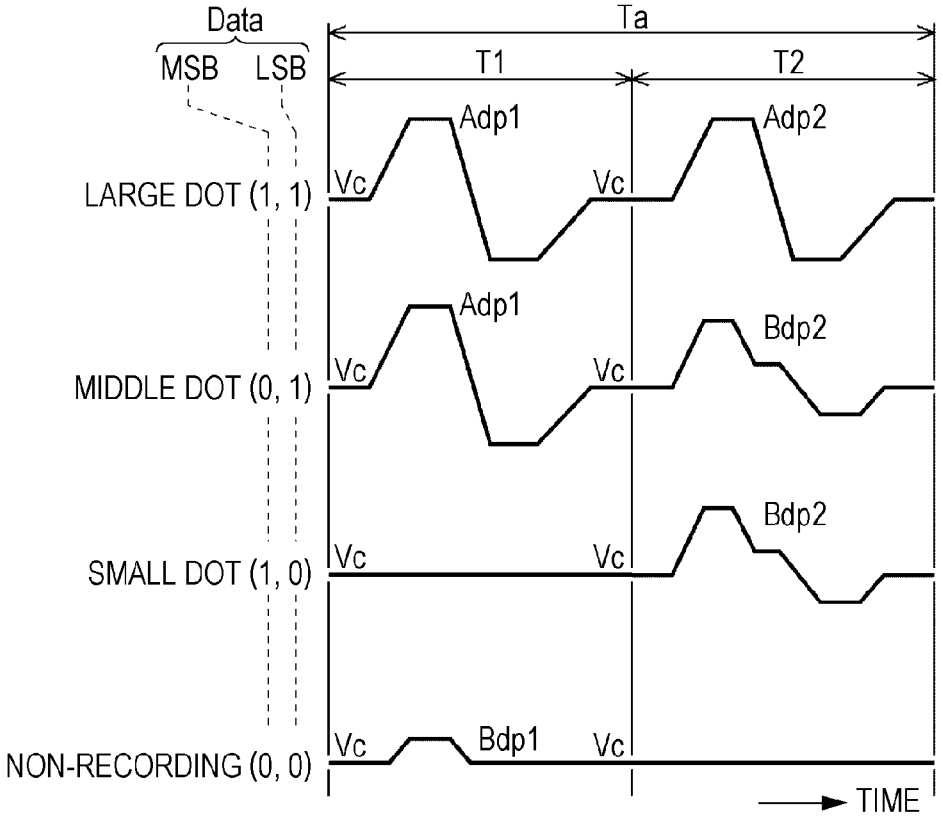
FIG. 9 is a diagram illustrating driving signals selected by the selection unit.

FIG. 9 is a diagram illustrating voltage waveforms of the driving signal selected according to the data signal Data and supplied to one end of the piezoelectric element 60 in the ejection mode.

When the data signal Data is (1, 1), the selection signals Sa and Sb are in the H and L levels in the period T1, respectively. Therefore, the transfer gate 234*a* is turned on and the transfer gate 234*b* is turned off. Therefore, the trapezoid waveform Adp1 of the driving signal COM-A is selected in the period T1. Since the selection signals Sa and Sb are in the H and L levels even in the period T2, the selection unit 230 selects the trapezoid waveform Adp2 of the driving signal COM-A.

Thus, when the trapezoid waveform Adp1 is selected in the period T1, the trapezoid waveform Adp2 is selected in the period T2, and the selected trapezoid waveform is supplied as the driving signal to one end of the piezoelectric element 60, the middle amount of ink is ejected separately twice from the nozzle 651 corresponding to this piezoelectric element 60. Therefore, the respective ink is landed to be integrated on the printing medium P and the large dot defined by the data signal Data is consequently formed.

When the data signal Data is (0, 1), the selection signals Sa and Sb are in the H and L levels in the period T1, respectively. Therefore, the transfer gate 234*a* is turned on and the transfer gate 234*b* is turned off. Therefore, the trapezoid waveform Adp1 of the driving signal COM-A is selected in the period T1. Since the selection signals Sa and Sb are in the L and H levels in the period T2, the trapezoid waveform Bdp2 of the driving signal COM-B is selected.

Accordingly, the middle amount of link and the small amount of ink are ejected separately twice from the nozzle. Therefore, the respective ink is landed to be integrated on the printing medium P and the middle dot defined by the data signal Data is consequently formed.

When the data signal Data is (1, 0), the selection signals Sa and Sb are in the L level together in the period T1. Therefore, the transfer gate 234*a* and the transfer gate 234*b* are turned off. Therefore, none of the trapezoid waveforms Adp1 and Bdp1 is selected in the period T1. When the transfer gates 234*a* and 234*b* are turned off together, a route from a connection point of the output ends of the transfer gates 234*a* and 234*b* to one end of the piezoelectric element 60 enters a high-impedance state in which there is no electric connection. However, the piezoelectric element retains a voltage ($Vc-V_{BS}$) immediately before the transfer gates are turned off, because of a capacitive property of the piezoelectric element 60.

Next, since the selection signals Sa and Sb are in the L and H level in the period T2, the trapezoid waveform Bdp2 of the driving signal COM-B is selected. Therefore, since the small amount of ink is ejected from the nozzle 651 only in the period T2, the small dot defined by the data signal Data is formed on the printing medium P.

When the data signal Data is (0, 0), the selection signals Sa and Sb are in the L and H levels in the period T1, the transfer gate 234*a* is turned off and the transfer gate 234*b* is turned on. Therefore, the trapezoid waveform Bdp1 of the driving signal COM-B is selected in the period T1. Next, since the selection signals Sa and Sb are in the L level together in the period T2, none of the trapezoid waveforms Adp2 and Bdp2 is selected.

Therefore, since the ink near the opening portion of the nozzle 651 merely vibrates minutely in the period T1 and no ink is ejected, no dot is consequently formed, that is, non-recording defined by the data signal Data is performed.

In this way, the selection unit 230 selects the driving signal COM-A or COM-B (or selects neither thereof) according to an instruction from the selection control unit 210 and supplies the selected driving signal to one end of the piezoelectric element 60. Therefore, each piezoelectric element 60 is driven according to the size of the dot defined by the data signal Data.

The driving signals COM-A and COM-B illustrated in FIG. 5 are merely examples. In practice, combinations of various waveforms prepared in advance are used according to a movement speed of the head unit 20, the nature of the printing medium P, and the like.

Here, the example in which the piezoelectric element 60 is bent upward with an increase in a voltage has been described. However, when the voltage supplied to the electrodes 611 and 612 is inverted, the piezoelectric element 60 is bent downward with an increase in a voltage. Therefore, in a configuration in which the piezoelectric element 60 is bent downward with an increase in a voltage, the driving signals COM-A and COM-B exemplified in the drawing are waveforms inverted using the voltage Vc as a criterion.

Thus, in the embodiment, one dot is formed on the printing medium P by using the period Ta, which is a unit period, as a unit. Therefore, in the embodiment in which one dot is formed by ejecting the ink droplets twice (maximally) in the period Ta, the ink ejection frequency f is 2/Ta and the dot interval D is a value obtained by dividing the movement speed v of the head unit by the ink ejection frequency f (=2/Ta).

In general, when ink droplets can be ejected Q times (where Q is an integer equal to or greater than 2) in a unit period T and one dot is formed by ejecting the ink droplets Q times, the ink ejection frequency f can be expressed as Q/T.

As in the embodiment, a time (period) necessary to form one dot is the same, but it is necessary to shorten a time in which one ink droplet is ejected once when dots with different sizes are formed on the printing medium P, compared to a case in which one dot is formed by ejecting a one-time ink droplet once.

It is not necessary to particularly describe the third method of forming two or more dots without joining the two or more ink droplets. Here, the waveforms of the driving signals COM-A and COM-B in the ejection mode and the ejection operation performed according to the waveforms have been described. In the sleep mode and the correction mode, the voltages of the driving signals COM-A and COM-B are constant, as will be described below. On the other hand, in the sleep mode and the correction mode, the selection unit 230 selects neither of the driving signal COM-A or COM-B.

Next, the driving circuits 50 will be described. To sum up, the two driving circuits 50 generate the driving signal COM-A (COM-B) as follows. That is, of the two driving circuits 50, one driving circuit first performs analog conversion on the data dA supplied from the control unit 100. Second, the driving circuit feeds back the driving signal COM-A to be output, corrects a deviation between a signal (attenuated signal) which is based on the driving signal COM-A and a target signal using a high-frequency component of the driving signal COM-A, and generates a modulated signal according to the corrected signal. The driving circuit third generates an amplified modulated signal by switching a transistor according to the modulated signal (by performing class D amplification), fourth smoothes the amplified modulated signal using a lowpass filter, and outputs the smoothed signal as the driving signal COM-A.

Of the two driving circuits 50, the other driving circuit also has the same configuration and differs merely in that the driving signal COM-B is output from the data dB. Accordingly, the driving circuit 50 outputting the driving circuit COM-A will be described as an example for convenience.

Figure 10:
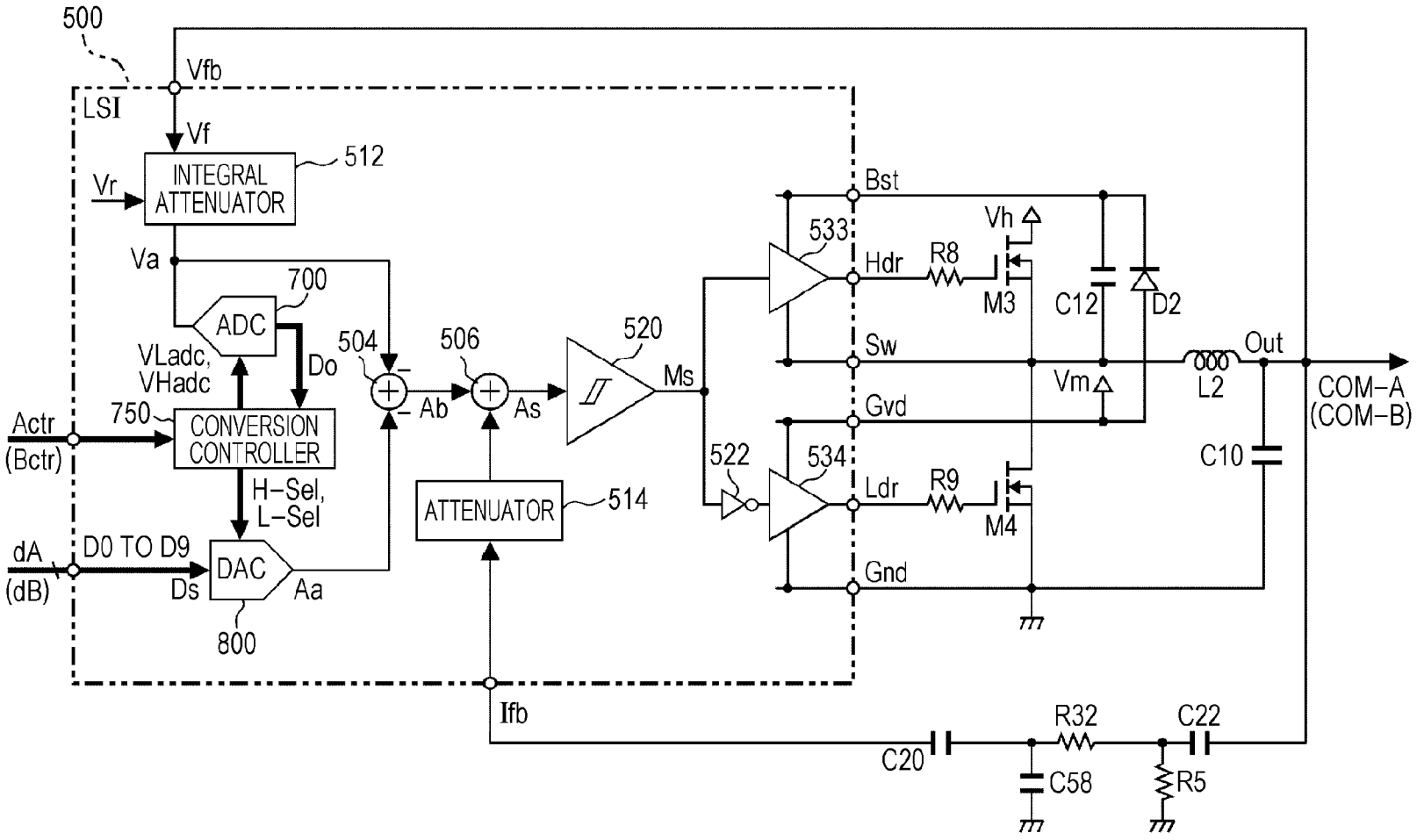
FIG. 10 is a diagram illustrating the configuration of a driving signal in the printing apparatus.

FIG. 10 is a diagram illustrating a circuit configuration of the driving circuit 50.

As illustrated in the drawing, the driving circuit is configured to include various elements such as resistors and capacitors in addition to an LSI 500, transistors M3 and M4.

FIG. 10 illustrates a configuration for outputting the driving signal COM-A. In the LSI 500, however, circuits configured to generate both of the driving signals COM-A and COM-B of two systems are packaged to one circuit in practice.

The large scale integration (LSI) 500 supplies a gate signal of each of the transistors M3 and M4 based on the 10-bit waveform data dA input from the control unit 100 via pins D0 to D9. In order to supply the gate signals, the LSI 500 includes an analog-to-digital converter (ADC) 700, a conversion controller 750, a digital-to-analog converter (DAC) 800, adders 504 and 506, an integral attenuator 512, an attenuator 514, a comparator 520, a NOT circuit 522, and gate drivers 533 and 534.

The integral attenuator 512 attenuates and integrates a signal Vf input via a pin Vfb, that is, the driving signal COM-A output from the terminal Out, and then supplies the driving signal COM-A as a signal Va to one of the input ends (−) of the adder 504 and the ADC 700.

Figure 11:
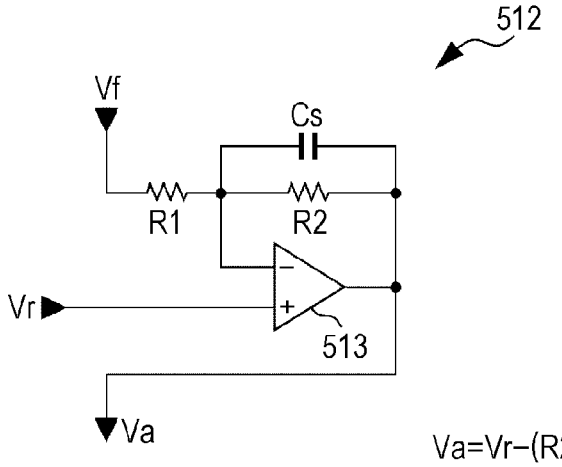
FIG. 11 is a diagram illustrating an integral attenuator in the driving circuit.

FIG. 11 is a diagram illustrating an example of the integral attenuator 512.

As illustrated in the drawing, the integral attenuator 512 includes an op-amplifier 513, resistors R1 and R2, and a capacitor Cs.

The signal Vf is supplied to a negative input end (−) of the op-amplifier 513 via the resistor R1 and a signal Vr is supplied to a positive input end (+) of the op-amplifier 513. The signal Va output from the op-amplifier 513 is feedback to the negative input end (−) of the op-amplifier 513 via parallel connection of the resistor R2 and the capacitor Cs.

Here, when the voltages of the signals Va, Vf, and Vr are assumed to be Va, Vf, and Vr as the symbols, the voltage of the signal Va output from the op-amplifier 513 can be expressed as in Expression (1) below:

$$Va=Vr-(R2/R1)\cdot(Vf-Vr) \quad (1).$$

Referring back to FIG. 10 for the description, the conversion controller 750 controls each of the ADC 700 and the DAC 800 according to an operation mode. Next, the operation mode will be described below.

Figure 12:
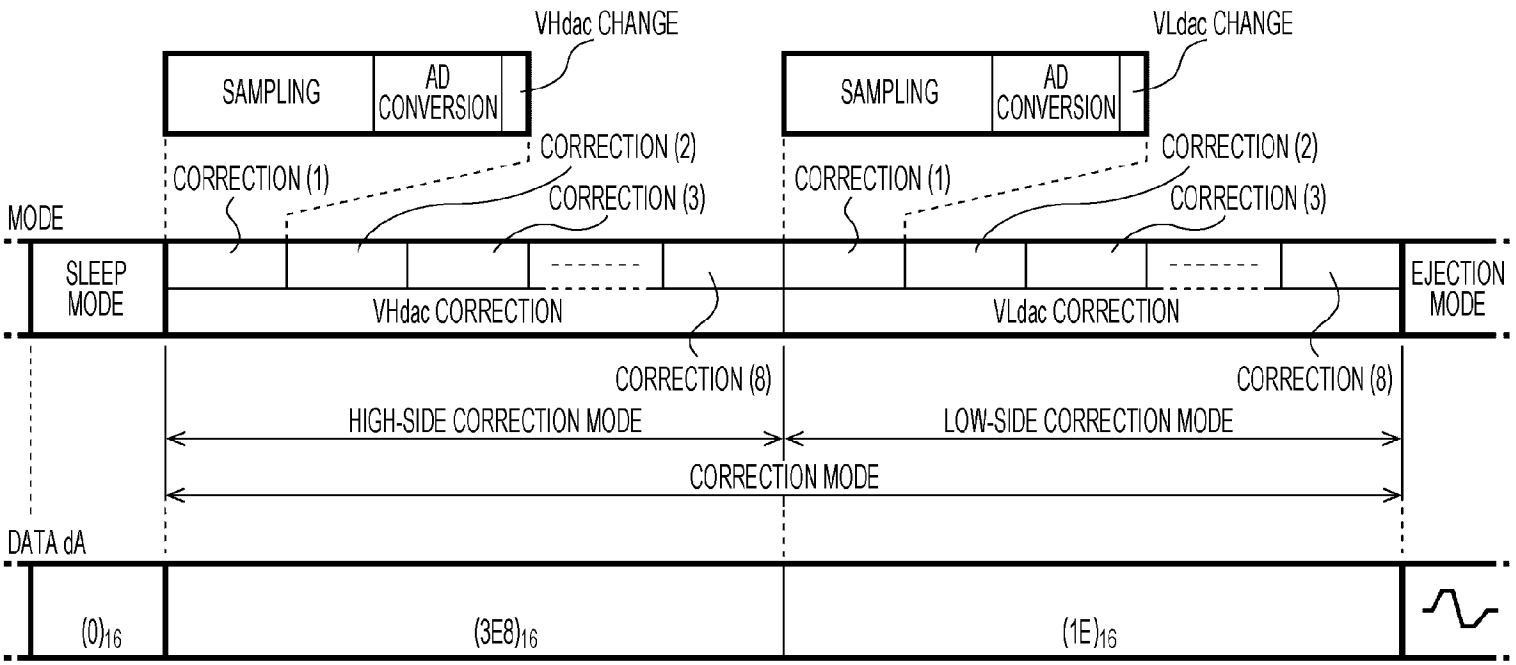
FIG. 12 is a diagram illustrating an operation mode in the printing apparatus.

FIG. 12 is a diagram for describing the operation mode according to the embodiment.

As illustrated in the drawing, the operation mode according to the embodiment includes the sleep mode in which part of power is stopped for power saving, the correction mode in which an output voltage range of the DAC 800 is corrected after the sleep mode, and the ejection mode in which printing is performed to eject ink after the correction mode. Of these modes, the correction mode includes two kinds of modes, that is, a high-side (High) correction mode in which the voltage of a higher side is corrected and a low-side (Low) correction mode in which the voltage of a lower side is corrected.

In the high-side correction mode, correction (1) to correction (8) are performed 8 times. Each of correction (1) to correction (8) in the high-side correction mode is further divided into the following three periods. That is, each correction is divided into a sampling period, an AD conversion period, and a VHadc change period.

On the other hand, in the low-side correction mode, correction (1) to correction (8) are performed 8 times. Likewise, each of correction (1) to correction (8) in the low-side correction mode is further divided into a sampling period, an AD conversion period, and a VLadc change period.

The sampling period, the AD conversion period, the VHadc change period, and the VLadc change period are illustrated in the drawing by omitting "period". The details of these periods will be described below including the voltages VHadc and VLadc.

In the ejection mode, the operation mode transitions to the sleep mode when printing is not performed for a predetermined time. When the printing is performed in the state of the sleep mode, the ejection mode is performed once through the correction mode.

Referring back to FIG. 10 for the description, the ADC 700 converts the signal Va output from the integral attenuator 512 into 3-bit data Do. The voltages VHadc and VLadc are applied from the conversion controller 750 to the ADC 700. As the details of the AD conversion by the ADC 700 are described below, the voltage VHadc is defined as the criterion of the high side (High) and the voltage VLadc is defined as the criterion of the low side (Low).

The conversion controller 750 supplies (applies) the voltages VHadc and VLadc to the ADC 700 and, on the other hand, supplies control signals H-Sel and L-Sel to the DAC 800.

The DAC 800 converts the 10-bit waveform data dA supplied from the control unit 100 into an analog signal Aa and outputs the analog signal Aa.

In the DA conversion, the control signal L-Sel is set to the criterion voltage of the low side and the control signal H-Sel is set to the criterion voltage of the high side. As will be described below in detail, for example, when the voltage of the signal Aa output from the DAC 800 is in the range of 1.000 to 2.000 volts, 1.000 volt which is the lower limit is the criterion voltage of the low side and is set as the control signal H-Sel. Further, 2.000 volts which is the upper limit is configured as the criterion voltage of the high side and is set as the control signal L-Sel.

Here, the lower limit voltage and the upper limit voltage to be output from the DAC 800 are assumed to be 1.000 volt and 2.000 volts, respectively. However, these voltages are appropriately corrected (adjusted) in the correction mode.

On the other hand, the control unit 100 supplies the waveform data dA according to the operation mode in the following relation.

Specifically, as illustrated in FIG. 12, in the sleep mode, the control unit 100 supplies data indicating $(0)_{16}$ expressed in the hexadecimal notation, that is, the control unit 100 supplies data indicating "0" expressed in the decimal notation as the waveform data dA.

In the high-side correction mode of the correction mode, the control unit 100 supplies data $(3E8)_{16}$, that is, data indicating "1000" expressed in the decimal notation, as the waveform data dA. In the low-side correction mode, the control unit 100 supplies data $(1E)_{16}$, that is, data indicating "30" expressed in the decimal notation. That is, the control unit 100 supplies the waveform data dA as a temporally fixed value in the sleep mode and in the high-side correction mode and the low-side correction mode of the correction mode.

On the other hand, the control unit 100 supplies data defining the trapezoid waveform of the driving signal COM-A as the waveform data dA in the ejection mode.

In the ejection mode, a signal obtained by performing class D amplification on the signal Aa converted from the waveform data dA through the analogy conversion is the driving signal COM-A. That is, the signal converted from the waveform data dA through the analog conversion is an original signal before the driving signal COM-A is amplified.

The reason why the voltage of the driving signal COM-A is attenuated by the integral attenuator 512 is that while the voltage of the signal Aa is about 2 volts which is the upper limit, the voltage of the terminal Out is amplified up to about 38 volts, and thus amplification ranges of both of the voltages can be matched at the time of obtaining of a deviation.

The adder 504 subtracts the voltage of the signal Aa from a voltage obtained by multiplying the voltage of the signal Va output from the integral attenuator 512 by a coefficient "−1" and supplies the subtraction result as a signal Ab to one of the input ends of the adder 506.

The integral attenuator 512 reverses the signal Va with respect to the signal Vf because of negative feedback, as illustrated in FIG. 11. Since the voltage of the signal Va is reversed to the coefficient "−1" again in the adder 504, the signal Ab which is an addition result of the adder 504 is a voltage obtained by subtracting the voltage of the signal Aa from the attenuated voltage of the signal supplied to the pin Vfb.

The attenuator 514 attenuates the high-frequency component of the driving signal COM-A input via a pin Ifb and supplies the attenuated driving signal COM-A to the other input end of the adder 506. The adder 506 supplies the comparator 520 with a signal As having the voltage obtained by adding the voltage at the one input end and the voltage at the other input end. The attenuation by the attenuator 514 is performed to match the amplitudes when the driving signal COM-A is feedback as in the integral attenuator 512.

The voltage of the signal As output from the adder 506 is a voltage obtained by subtracting the voltage of the signal Aa from the attenuated voltage of the signal supplied to the pin Vfb and adding the attenuated voltage of the signal supplied to the pin Ifb. Therefore, the voltage of the signal Ab by the adder 506 can be said to be a signal obtained by correcting a deviation between the attenuated voltage of the driving signal COM-A output from the terminal Out and the voltage of the signal Aa which is a target using the high-frequency component of the driving signal COM-A.

The comparator 520 outputs a modulated signal Ms subjected to pulse modulation as follows based on an added voltage by the adder 506. Specifically, the comparator 520 outputs the modulated signal Ms which becomes the H level when the signal As output from the adder 506 is equal to or greater than a voltage Vth1 serving as a threshold value at the time of an increase in the voltage and which becomes the L level when the signal As is less than the value Vth2 serving as a voltage threshold at the time of a decrease in the voltage. As will be described below, the voltage threshold value is set to have the following relation:

$$Vth1>Vth2.$$

The modulated signal Ms by the comparator 520 is supplied to the gate driver 534 through logic inversion performed by the NOT circuit 522. On the other hand, the modulated signal Ms is supplied to the gate driver 533 without the logic inversion. Therefore, the logic levels supplied to the gate drivers 533 and 534 have a mutually exclusive relation.

The logic levels supplied to the gate drivers 533 and 534 may be actually subjected to timing control so that the logic levels do not become the H level simultaneously (so that the transistors M3 and M4 are not turned on simultaneously). Therefore, the term "exclusive" has, strictly speaking, a meaning that the logic levels do not become the H levels simultaneously (the transistors M3 and M4 are not turned on simultaneously in terms of the transistors M3 and M4).

Incidentally, the term "the modulated signal" mentioned here is the modulated signal Ms in a narrow sense. However, when the modulated signal is subjected to pulse modulation according to the signal Aa, a negation signal (the NOT circuit 522) of the modulated signal Ms is also included in the modulated signal. That is, the modulated signal subjected to the pulse modulation according to the signal Aa includes not only the modulated signal Ms but also a signal obtained by inverting the logic level of the modulated signal Ms or a signal subjected to timing control.

Since the comparator 520 outputs the modulated signal Ms, circuits up to the comparator 520 on the downstream side of the DAC 800 outputting the signal Aa as the original signal, that is, the adders 504 and 506, the integral attenuator 512, the attenuator 514, and the comparator 520, can be said to be a modulation circuit generating the modulated signal Ms.

The gate driver 534 performs amplification conversion on the output signal of the NOT circuit 522, that is, a logic conversion signal of the modulated signal Ms by the comparator 520. Specifically, the gate driver 534 shifts a low logic amplitude (for example, an L level: 0 volts and an H level: 3.3 volts) of the output signal of the NOT circuit 522 to a high logic amplitude (for example, an L level: 0 volts and an H level: 7.5 volts) of the output signal and supplies the shifted signal as a gate signal from a pin Ldr to a gate electrode of the transistor M4 via a resistor R9. Of power supply voltages of the gate driver 534, a high-side voltage is a voltage Vm (for example, 12 volts) applied via a pin Gvd and a low-side voltage is zero voltage applied via a pin Gnd. That is, the pin Gvd is grounded to the ground. The pin Gvd is connected to a cathode electrode of a diode D2 for backflow prevention and an anode electrode of the diode D2 is connected to one end of a capacitor C12 and a pin Bst.

The gate driver 533 performs level shift to shift the low logic amplitude of the modulated signal Ms which is an output signal of the comparator 520 to the high logic amplitude and supplies the modulated signal Ms as a gate signal from a pin Hdr to a gate electrode of the transistor M3 via a resistor R8. Of power supply voltages of the gate driver 533, a high-side voltage is a voltage applied via the pin Bst and a low-side voltage is a voltage applied via a pin Sw. The pin Sw is connected to a source electrode of the transistor M3, a drain electrode of the transistor M4, and the other end of the capacitor C12, and one end of the inductor L2.

The transistors M3 and M4 are, for example, N-channel field effect transistors (FETs). Of these transistors, in the transistor M3 of the high side, a voltage Vh (for example, 42 volts) is applied to a drain electrode. In the transistor M4 of the low side, a source electrode is grounded to the ground.

Each of the transistors M3 and M4 is turned on when the gate signal is in the H level. Therefore, a modulated amplified signal obtained by amplifying the modulated signal Ms appears at the pin Sw (one end of the inductor L2) which is a connection point of the source electrode of the transistor M3 and the drain electrode of the transistor M4. Therefore, the transistors M3 and M4 are a pair of transistors outputting the modulated amplified signal obtained by amplifying the modulated signal.

When the gate signal to the transistor M4 is in the H level, that is, the transistor M4 is turned on, the voltage Vm is formed at the pin Bst via the diode D2 and the voltage at the pin Sw is zero (grounded). Therefore, the capacitor C12 is charged so the voltage Vh is formed at the other end thereof.

When the transistor M4 is turned off and outputs the gate signal with the H level to the transistor M3, a voltage at which the capacitor C12 is charged at the time of OFF of the transistor M4 is used as the power supply voltage of the gate driver 533.

There is a relation in which one of the gate drivers 533 and 534 is a first gate driver and the other thereof is a second gate driver.

The other end of the inductor L2 is a terminal Out from which the driving signal is output in the driving circuit 50, and the driving signal COM-A is supplied from the terminal Out to the head unit 20 via the flexible cable 190 (see FIGS. 1 and 2).

The terminal Out is connected to one end of the capacitor C10, one end of the capacitor C22, and the pin Vfb. Of the capacitor C10, the capacitor C22, and the pin Vfb, the other end of the capacitor C10 is grounded to the ground. Therefore, the inductor L2 and the capacitor C10 function as a lowpass filter (LPF) that smoothes the amplified modulated signal appearing at the connection point of the transistors M3 and M4.

The other end of the capacitor C22 is connected to one end of the resistor R5 and one end of a resistor R32. Of the resistor R5 and the resistor R32, the other end of the resistor R5 is grounded to the ground. Therefore, the capacitor C22 and the resistor R5 function as a highpass filter (HPF) that passes a high-frequency component equal to or greater than a cutoff frequency in the driving signal COM-A from the terminal Out. The cutoff frequency of the HPF is set to, for example, about 9 MHz.

The other end of the resistor R32 is connected to one end of a capacitor C20 and one end of a capacitor C58. Of the capacitor C20 and the capacitor C58, the other end of the capacitor C58 is grounded to the ground. Therefore, the resistor R32 and the capacitor C58 function as a lowpass filter (LPF) that passes a low-frequency component equal to or less than a cutoff frequency in the signal components passing through the HPF. The cutoff frequency of the LPF is set to, for example, about 160 MHz.

Since the cutoff frequency of the HPF is set to be lower than the cutoff frequency of the LPF, the HPF and the LPF function as a band-pass filter (BPF) that passes a high-frequency component of a predetermined frequency region in the driving signal COM-A.

The other end of the capacitor C20 is connected to the pin Ifb of the LSI 500. Thus, a direct-current component of the high-frequency component in the driving signal COM-A passing through the BPF is cut and the driving signal COM-A is feedback to the pin Ifb.

Incidentally, the driving signal COM-A output from the terminal Out is a signal obtained when the lowpass filter formed by the inductor L2 and the capacitor C10 smoothes the amplified modulated signal at the connection point (the pin Sw) of the transistors M3 and M4. The driving signal COM-A is integrated and subtracted via the pin Vfb, and then is positively feedback to the adder 504. Therefore, the driving signal COM-A is subjected to self-excited oscillation at a frequency decided by delay of the feedback (a sum of delay occurring in the smoothing of the inductor L2 and the capacitor C10 and delay occurring in the integral attenuator 512) and a transfer function of the feedback.

However, since the delay amount of a feedback route via the pin Vfb is large, the frequency of the self-excited oscillation may not be set to be high enough to ensure the accuracy of the driving signal COM-A sufficiently only in the feedback via the pin Vfb.

Accordingly, in the embodiment, apart from the route via the pin Vfb, a route in which the high-frequency component of the driving signal COM-A is feedback via the pin Ifb is provided so that the delay decreases from the viewpoint of the entire circuit. Therefore, the frequency of the signal As obtained by adding the high-frequency component of the driving signal COM-A to the signal Ab is increased so that the accuracy of the driving signal COM-A can be sufficiently ensured, compared to a case in which a route via the pin Ifb is not present.

Figure 13:
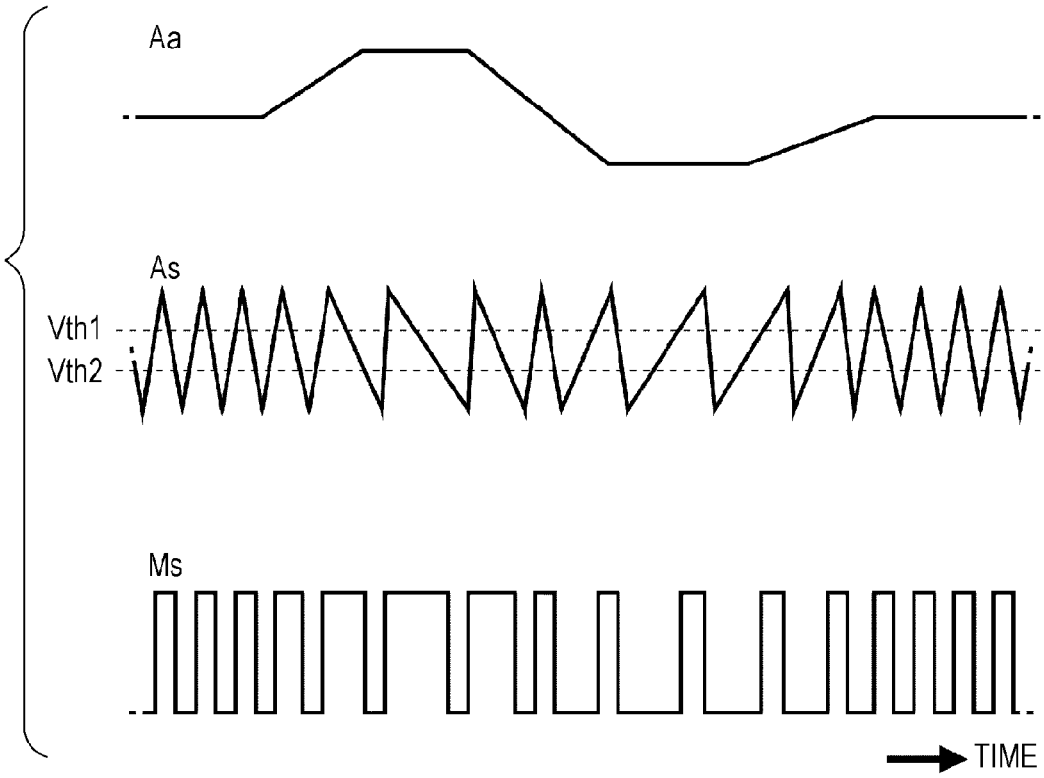
FIG. 13 is a diagram for describing an operation of the driving circuit.

FIG. 13 is a diagram illustrating the waveforms of the signal As and the modulated signal Ms in association with the waveform of the analog signal Aa.

As illustrated in the drawing, the signal As is a triangular wave and its oscillation frequency varies according to a voltage (input voltage) of the analog signal Aa. Specifically, when the input voltage is an intermediate value, the oscillation frequency increases. When the input voltage increases or decreases from the intermediate value, the oscillation frequency decreases.

The slope of the triangular wave of the signal As is approximately identical between a rise (increase in the voltage) and a fall (decrease in the voltage), when the input voltage is near the intermediate value. Therefore, a duty ratio of the modulated signal Ms which is a result obtained by comparing the signal As to the voltage threshold values Vth1 and Vth2 by the comparator 520 is approximately 50%. When the input voltage increases from the intermediate value, the slope of the fall of the signal As becomes gentle. Therefore, a period in which the modulated signal Ms is in the H level is relatively lengthened, and thus the duty ratio increases. Conversely, when the input voltage decreases from the intermediate value, the slope of the rise of the signal As becomes gentle. Therefore, a period in which the modulated signal Ms is in the L level is relatively shortened, the duty ratio decreases.

Therefore, the modulated signal Ms becomes the following pulse density modulated signal. That is, the duty ratio of the modulated signal Ms is approximately 50% at the intermediate value of the input voltage. When the input voltage increases from the intermediate value, the duty ratio increases. When the input voltage decreases from the intermediate value, the duty ratio decreases.

The gate driver 533 turns on and off the transistor M3 based on the modulated signal Ms described above. That is, the gate driver 533 turns on the transistor M3 when the modulated signal Ms is in the H level and turns off the transistor M3 when the modulated signal Ms is in the L level. The gate driver 534 turns on and off the transistor M4 based on a logic conversion signal of the modulated signal Ms. That is, the gate driver 534 turns off the transistor M4 when the modulated signal Ms is in the H level and turns on the transistor M4 when the modulated signal Ms is in the L level.

Accordingly, the voltage of the driving signal COM-A obtained by smoothing the amplified modulated signal at the connection point of the transistors M3 and M4 by the inductor L2 and the capacitor C10 increases as the duty ratio of the modulated signal Ms increases and decreases as the duty ratio thereof decreases. Consequently, the driving signal COM-A is controlled to become a signal in which the voltage of the analog signal Aa is expanded, and then is output.

Since the driving circuit 50 uses the pulse density modulation, there is the advantage in which a change width of the duty ratio is larger than that in pulse width modulation in which a modulation frequency is fixed.

That is, since the minimum positive pulse width and the minimum negative pulse width which can be handled in the entire circuit are restricted due to the circuit characteristics, only a predetermined range (for example, a range from 10% to 90%) may be ensured as the change width of the duty ratio in the pulse width modulation in which the frequency is fixed. In the pulse density modulation, however, the oscillation frequency is lowered as the input voltage becomes distant from the intermediate value. Therefore, the duty ratio can be increased in a region in which the input voltage is high. The duty ratio can be decreased in a region in which the input voltage is low. Thus, in the self-excited oscillation type pulse density modulation, a broader range (for example, a range from 5% to 95%) can be ensured as the change width of the duty ratio.

The driving circuit 50 is a self-excited oscillation circuit, and thus a circuit generating carrier waves with a high frequency is not necessary as in separate-excited oscillation. Therefore, there is the advantage in which a portion other than a circuit handling a high voltage, that is, a portion of the LSI 500 is easily integrated.

Additionally, in the driving circuit 50, not only the route in which the high-frequency component is feedback via the pin Vfb but also the route via the pin Ifb are present as the feedback routes of the driving signal COM-A. Therefore, the delay is small from the viewpoint of the entire circuit. Thus, since the frequency of the self-excited oscillation increases, the driving circuit 50 can generate the driving signal COM-A with high accuracy.

Figure 14:
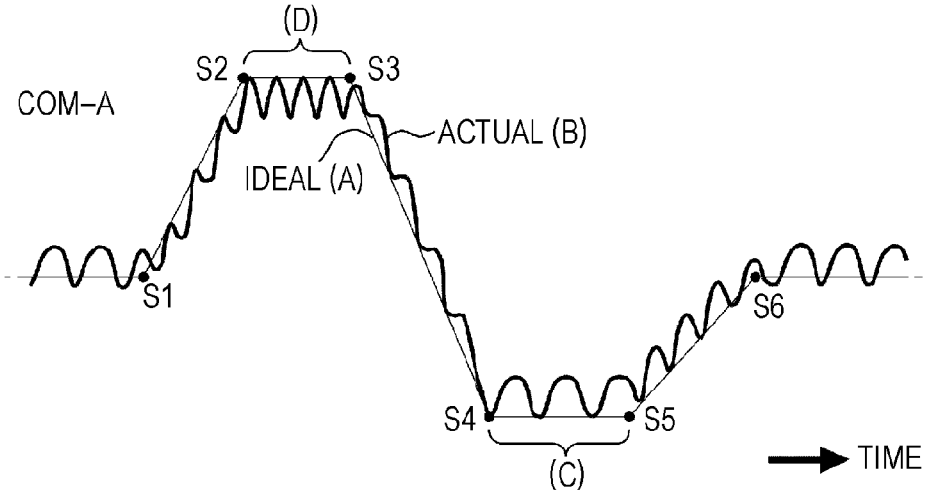
FIG. 14 is a diagram illustrating the waveform of a driving signal actually output by the driving circuit.

Incidentally, as described above, the driving signal COM-A is a signal obtained when the lowpass filter smoothes the amplified modulated signal at the transistors M3 and M4. Therefore, a waveform indicated by a thin line (A) of FIG. 14 is ideal. However, as indicated by a thick line (B) of the drawing, ripples actually remain. Therefore, ripples also remain in the waveform of the signal Va integrated and attenuated from the driving signal COM-A.

Thus, when the signal in which the ripples remain is subjected to the AD conversion and the number of points to be sampled is only one, reliability lacks. Therefore, by first sampling an analog signal at a plurality of points, converting sampled voltages into digital values, and second obtaining an average value of the digital values, the influence of the ripples can be considered to be reduced. In this configuration, it necessarily takes some time to calculate the average value. Therefore, a total time until output of the average value from the sampling may be increased.

In view of such a circumstance, the average value of the voltages sampled at the plurality of points can be obtained at the time of the AD conversion of the driving signal COM-A in which the ripples remain. Further, an AD converter shortening the total time until the average value is digitally output is preferred. The ADC 700 in the embodiment is provided in light of such a circumstance and has a configuration in that it is possible to shorten the total time until the average value of the voltages sampled at the plurality of points is digitally output with high accuracy.

On the other hand, when class D amplification is performed so that the driving signal is feedback to become similar to the waveform of the signal Aa and ripples remain in the driving signal, the following control is performed in order to improve waveform accuracy. Specifically, to improve coordinate accuracy of changing points (S1 to S6 in FIG. 14) particularly, control is performed such that the lower limit of the ripples becomes a target value (ideal), as indicated by (C) when the voltage of the driving signal is low. In contrast, when the voltage of the driving signal is high, as indicated by (D) of the drawing, control is performed such that the upper limit of the ripples becomes a target value.

In a configuration in which a trapezoid waveform which is a driving signal is supplied to a piezoelectric element to eject an ink droplet, the average value of the ripples has a large influence on the ejection of the ink droplet. The amplitude or period of the ripples are changed not only by fluctuation of the power supply voltage (Vh, ground) but also by the characteristics of the lowpass filter smoothing the amplified modulated signal, that is, the inductance of the inductor L2 and the capacitance of the capacitor C10.

For this reason, when mass production is assumed and the characteristics of the lowpass filter varies in the plurality of printing apparatuses 1, the average value of the ripples may differ despite the fact that control is appropriately performed such that the lower limit and the upper limit of the ripples become the target values.

Figure 15A:
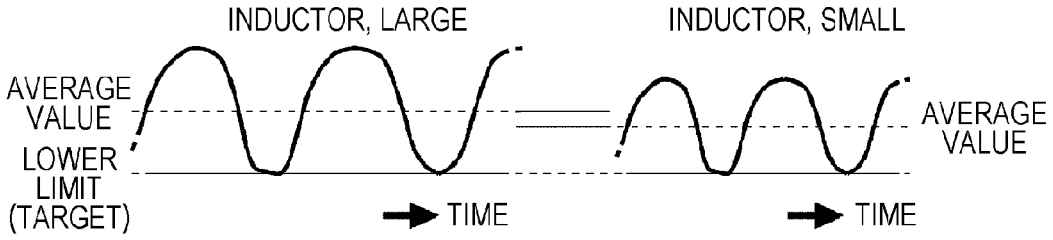
FIGS. 15A and 15B are partially expanded diagrams illustrating the waveforms of driving signals with ripples.

For example, as illustrated in FIG. 15A, when the inductance of the inductor L2 is larger than a designed value, as indicated in the left column, in a state in which the driving voltage is low, that is, a state in which the lower limit of the ripples becomes a target value, both of the period and the amplitude of the ripples are enlarged, and thus the average of the ripples is increased. In contract, when the inductance of the inductor L2 is smaller than the designed value, as indicated in the right column, the period and the amplitude are reduced, and thus the average value of the ripples is decreased in a state in which the driving voltage is low.

Figure 15B:
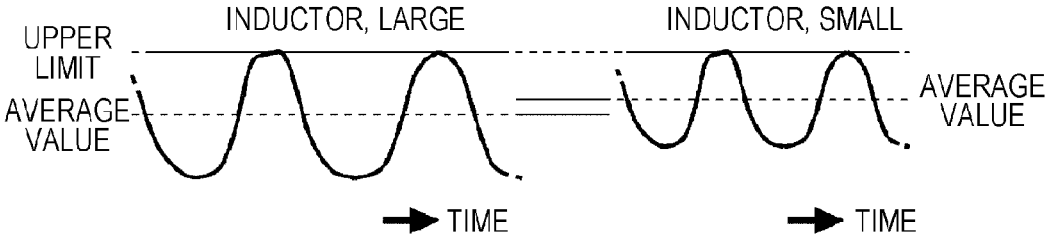

On the other hand, as illustrated in FIG. 15B, when the inductance of the inductor L2 is larger than a designed value, as indicated in the left column, in a state in which the driving voltage is high, that is, a state in which the upper limit of the ripples becomes a target value, the average of the ripples is decreased. When the inductance of the inductor L2 is smaller than the designed value, as indicated in the right column, the average value of the ripples is increased in a state in which the driving voltage is high.

As described above, the ADC 700 performs the AD conversion on the average value of the integrated and attenuated signal of the driving signal COM-A in which the ripples remain. The DAC 800 outputs a target signal when the driving signal COM-A is generated.

Therefore, in the embodiment, a configuration is adopted in which an output of the DAC 800 is corrected using the data Do subjected to the AD conversion by the ADC 700. Thus, even when the characteristics of the lowpass filter vary, the control is performed such that the average value of the ripples becomes a predetermined voltage.

Accordingly, the ADC 700 and the DAC 800 will be described in this order below.

Figure 16:
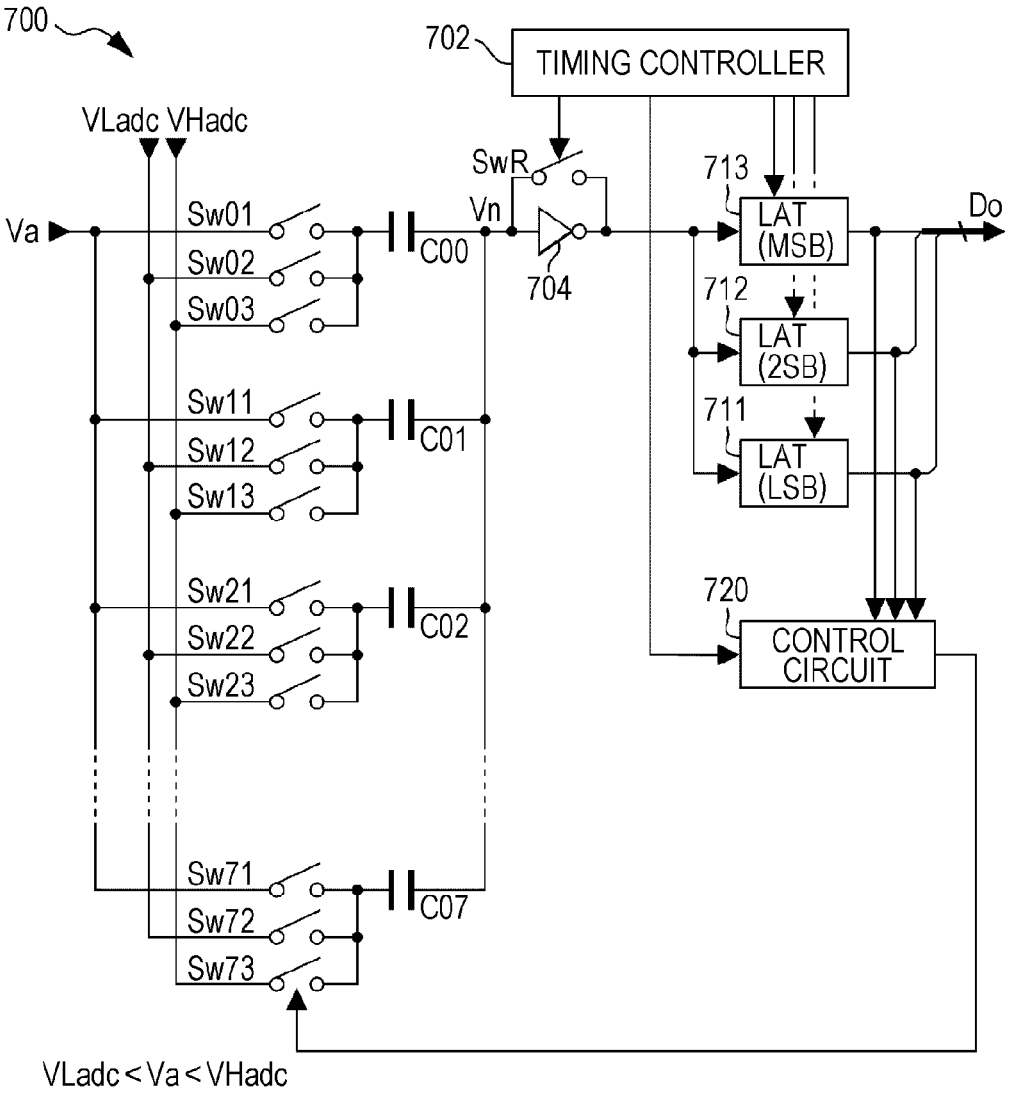
FIG. 16 is a diagram illustrating a first example of an ADC in the driving circuit.

FIG. 16 is a diagram illustrating the configuration (first example: sequential conversion type) of the ADC 700.

In the drawing, the ADC 700 converts the voltage of the signal Va output from the integral attenuator 512 using 3 bits. Although partially omitted, the ADC 700 includes switches Sw01, Sw02, Sw03, Sw11, Sw12, Sw13, Sw21, Sw22, Sw23, Sw31, Sw32, Sw33, Sw41, SW42, Sw43, Sw51, Sw52, Sw53, Sw61, Sw62, Sw63, Sw71, Sw72, Sw73, and SwR, capacitors C00 to C07, a timing controller 702, a NOT circuit 704 serving as a comparator, latch circuits (denoted by "LAT") 711, 712, and 723, and a control circuit 720.

In order to facilitate the description, for example, the switches Sw01, Sw11, Sw21, Sw31, Sw41, Sw51, Sw61, and Sw71 are collectively referred to as switches Sw*1 in some cases. That is, when a common switch is denoted by the single-digit "1" between the double digit numbers after the switches Sw, the ten-digit is shown representing the number as "*." In this case, "*" is an integer of "0" to "7."

Likewise, between double digit numbers after the switches Sw, the common switch of the single-digit "2" is turned on and notated with the switch Sw*2, and the common switch of the single-digit "3" is turned on and notated with the switch Sw*3 in some cases.

As illustrated in the drawing, one end of the switch Sw*1 is commonly connected and is supplied with the signal Va from the integral attenuator 512 (see FIG. 10). One end of the switch Sw*2 is commonly connected and the voltage VLadc output from the conversion controller 750 is applied to each switch. One end of the switch Sw*3 is commonly connected and the voltage VHadc output from the conversion controller 750 is applied to each switch.

The ADC 700 outputs 3 bits to indicate at which position (level) the voltage of the signal Va is present in a voltage range from the voltage VHadc of the high side to the voltage VLadc of the low side. Particularly, the ADC 700 outputs a signal to indicate to which region the voltage of the signal Va belongs among regions divided from the range from the voltage VHadc to the voltage VLadc. At this time, a high side of the voltage which is a conversion target is expressed with "000" in the binary notation and a low side of the voltage is expressed with "111."

The control circuit 720 controls ON/OFF of the switches Sw*1, Sw*2, and Sw*3.

The other ends of the switches Sw01, Sw02, and Sw03 are commonly connected to one end of the capacitor C00. Likewise, the other ends of the switches Sw11, Sw12, and Sw13 are commonly connected to one end of the capacitor C01. In this way, between the double digit numbers after the switches Sw, the other ends of three common switches of the ten-digit with "?" are commonly connected to the other end of the capacitor C0?. Further, "?" is an integer of "0" to "7." The capacitances (capacitance values) of the capacitors C00 to C07 are substantially the same.

The other ends of the capacitors C00 to C07 are commonly connected to the input end of the NOT circuit 704 and one end of the switch SwR. Here, the NOT circuit 704 is, for example, a CMOS inverter and outputs the L level when the voltage of the input end is equal to or greater than a voltage Vth which is a threshold value. The NOT circuit 704 outputs the H level when the voltage of the input end is less than the voltage Vth.

The voltage Vth is designed to become a value corresponding to a substantial center of the voltage VHadc and the voltage VLadc. A voltage at a common connection point of the other ends of the capacitors C00 to C07, that is, the input end of the NOT circuit 704, is assumed to be Vn.

The timing controller 702 controls ON/OFF of the switch SwR.

The output end of the NOT circuit 704 and the other end of the switch SwR are commonly connected to the input ends of latch circuits 711, 712, and 713.

Each of the latch circuits 711, 712, and 713 individually latches an input signal at a timing designated by the timing controller 702 and outputs the input signal.

Here, in regard to 3 bits of the data Do output by the ADC 700, the signal latched by the latch circuit 711 is the least significant LSB, the signal latched by the latch circuit 712 is the second significant 2SB, and the signal latched by the latch circuit 713 is the most significant MSB.

The control circuit 720 controls ON/OFF of the switches Sw*1, Sw*2, and Sw*3 according to the signals output from the latch circuits 711, 712, and 713 under the control of the timing controller 702.

The ADC 700 samples the voltage of the signal Va output from the integral attenuator 512 at eight temporally different points during a sampling period, subsequently equalizes charges corresponding to the voltages sampled at the eight points during a period of the AD conversion, and outputs the result as the 3-bit data Do in this order. This, the sampling period will be first described.

Figure 17:
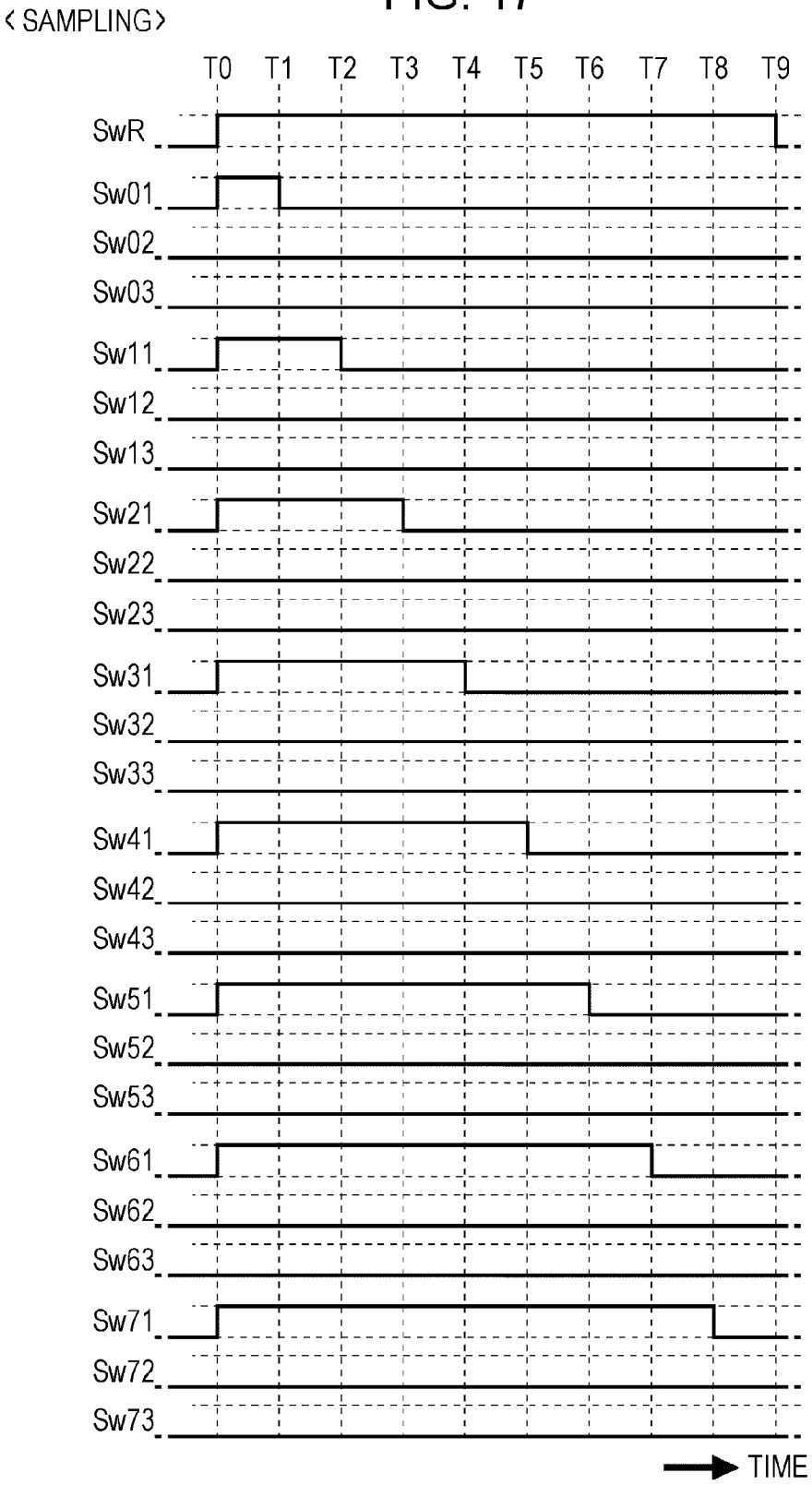
FIG. 17 is a timing chart illustrating a sampling operation in the ADC.

FIG. 17 is a timing chart indicating ON/OFF of each switch during the sampling period in the ADC 700. Each switch is turned on with the H level and is turned off with the L level. Further, ON/OFF of the switch SwR is controlled by the timing controller 702 and the switches Sw*1, Sw*2, and Sw*3 are controlled by the control circuit 720, as described above.

First, at time T0, the switches SwR and Sw*1 are controlled to be turned on. Further, the switches Sw*2 and Sw*3 are maintained to be off during the whole of the sampling period.

When the switch SwR is turned on, the input end and the output end of the NOT circuit 704 are short-circuited. Therefore, the voltage Vn of the other ends (input of the comparator) of the capacitors C00 to C07 becomes the voltage Vth of the threshold value in the NOT circuit 704. On the other hand, when the switches Sw*1 are turned on, the voltage of the one ends of the capacitors C00 to C07 becomes the voltage of the signal Va.

Next, at time T1, the switch Sw01 is controlled to be turned off. When the switch Sw01 is turned off, the voltage of the signal Va at time T1 is sampled and maintained at the one end of the capacitor C01.

For convenience, the voltage at this time is denoted by Va (T1). Since the voltage of the other end of the capacitor C01 is the voltage Vth, a voltage |Va (T1)−Vth| is maintained in the capacitor C00.

Subsequently, the switches Sw11, 521, Sw31, Sw41, Sw51, Sw61, and Sw71 are sequentially controlled to be turned off from time T2 to time T8 in a similar manner, the voltage of the other ends of the capacitors C00 to C07 are maintained with the voltage Vth of the threshold value and, in this state, the following voltage is maintained:

a voltage Va (T2) is maintained at the one end of the capacitor C01;

a voltage Va (T3) is maintained at the one end of the capacitor C02;

a voltage Va (T4) is maintained at the one end of the capacitor C03;

a voltage Va (T5) is maintained at the one end of the capacitor C04;

a voltage Va (T6) is maintained at the one end of the capacitor C05;

a voltage Va (T7) is maintained at the one end of the capacitor C06; and a voltage Va (T8) is maintained at the one end of the capacitor C07.

Then, at time T9, when the switch SwR is controlled to be turned off, charges according to the voltages sampled and maintained at time T1 to time T8 are accumulated in the capacitors C00 to C07.

Figure 18:
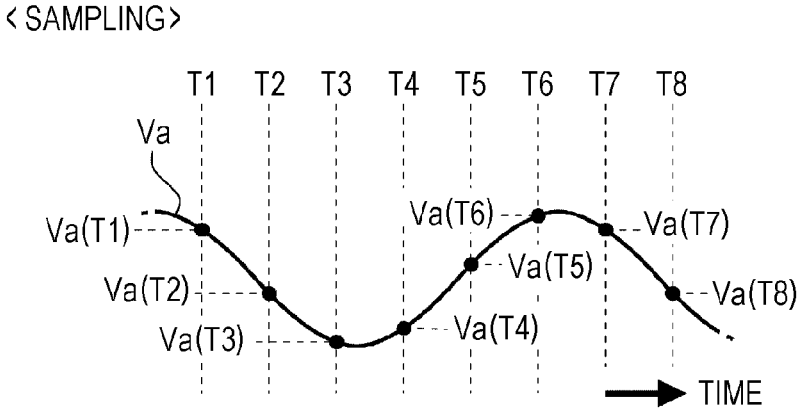
FIG. 18 is a diagram illustrating the sampling operation in the ADC.

FIG. 18 is a diagram the points at which the voltage Va is sampled at the one ends of the capacitors C00 to C07 at time T1 to time T8 and which are indicated by black dots.

When the charges sampled at the eight points are accumulated in the capacitors C00 to C07, the charges are equalized during the AD conversion period and the AD conversion is performed based on the equalized charges.

Next, an operation of the AD conversion will be described.

Figure 19:
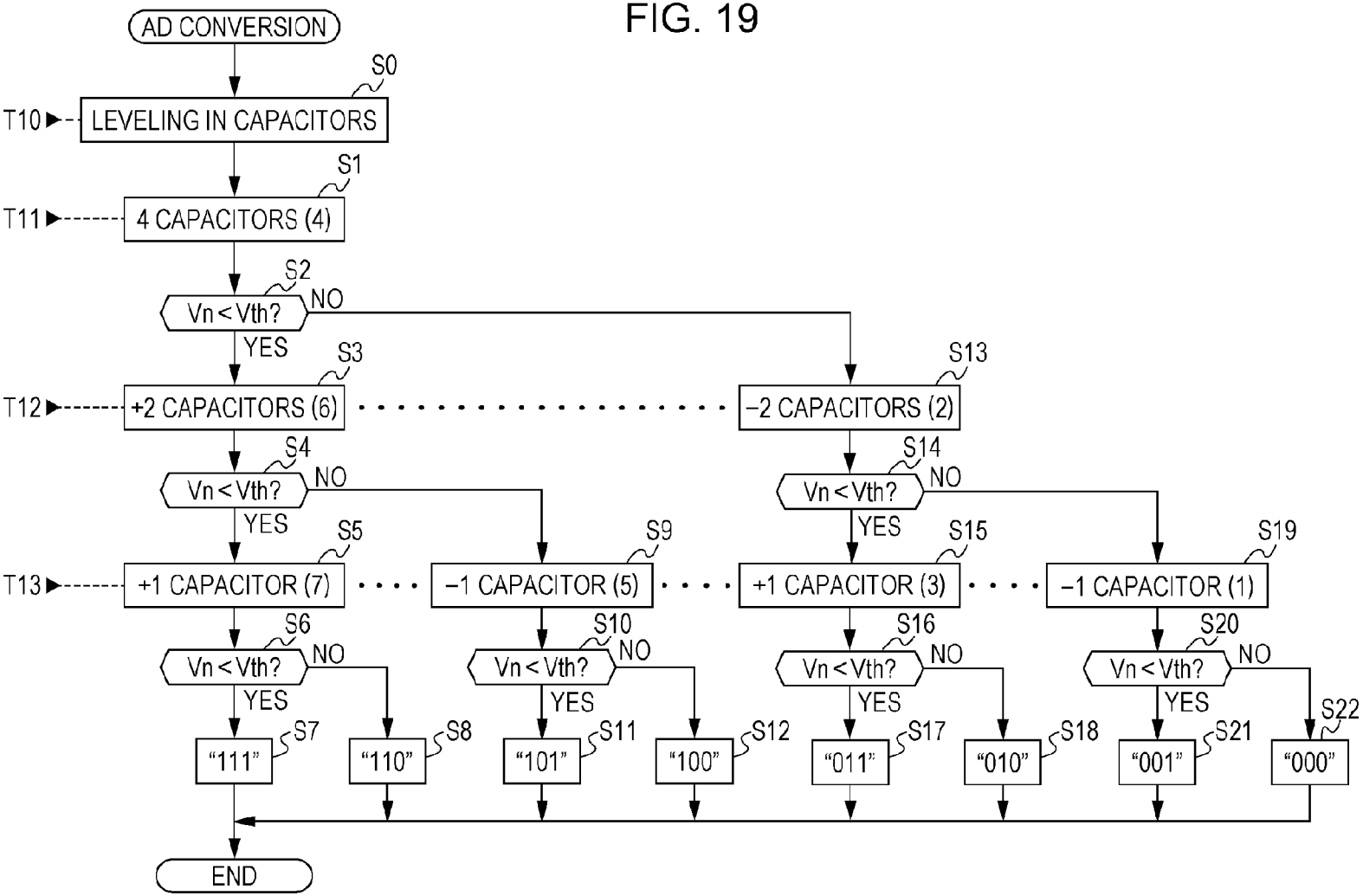
FIG. 19 is a flowchart illustrating an AD conversion operation in the ADC.
Figure 20:
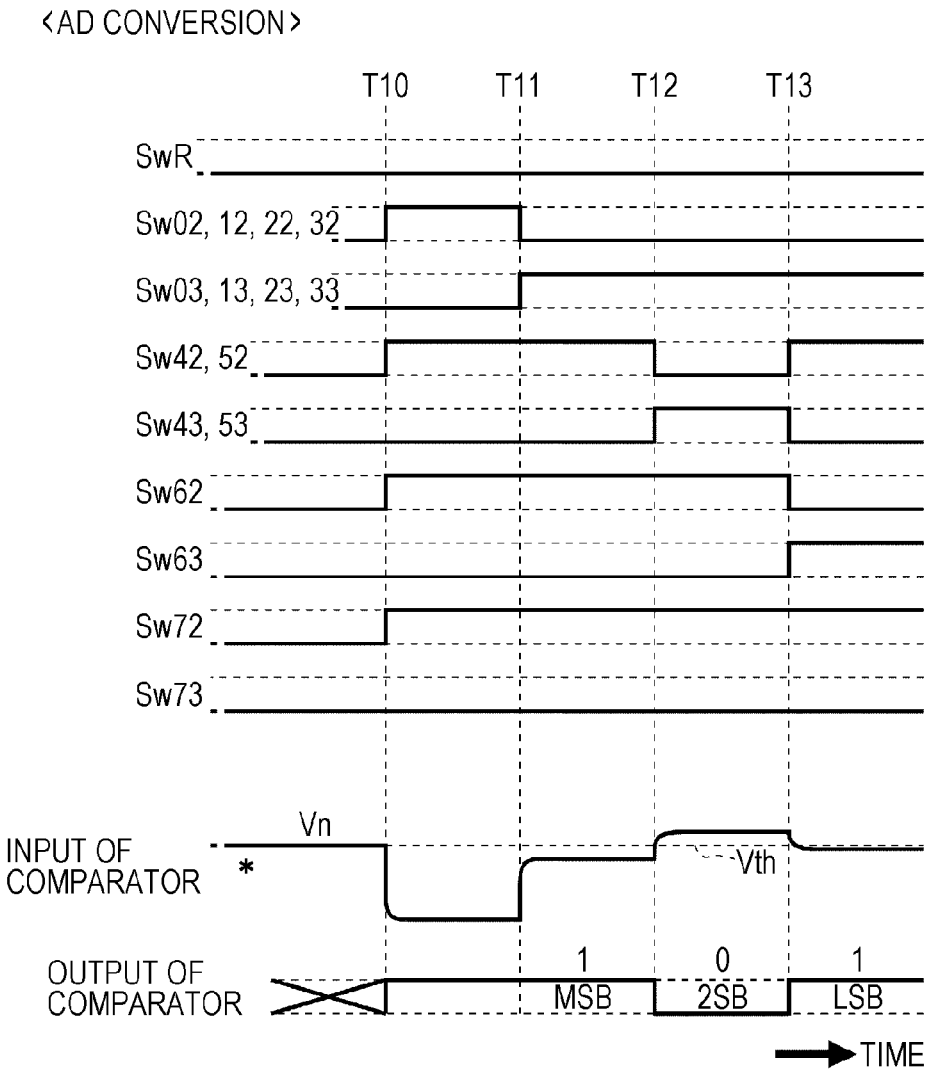
FIG. 20 is a timing chart illustrating an AD conversion operation.

FIG. 19 is a flowchart illustrating the operation during the AD conversion period in a first example. FIG. 20 is a timing chart illustrating the example of the operation with ON/OFF of each switch.

First, the switches Sw*2 are controlled to be turned on at time T10 after time T9 during the sampling period (step S0). The switches SwR and Sw*3 are maintained to be off during the whole of the AD conversion period. Although omitted in FIG. 20, the switches Sw*01 are also maintained to be off.

When the switches Sw*2 are turned on, the voltage VLadc of the low side is applied to each of the one ends of the capacitors C00 to C07. That is, in the state in which the capacitors C00 to C07 are connected in parallel, the voltage VLadc is applied to the one end of each capacitor. Therefore, the charges according to the voltages of the signal Va sampled at the eight points with respect to the voltage Vth are equalized to be accumulated in the capacitors C00 to C07. In short, the charges according to the average value of the voltages of the signal Va are accumulated in the capacitors C00 to C07. Accordingly, an operation of performing the AD conversion on the voltages based on the charges is performed subsequently.

The voltage Vn at the other ends of the capacitors C00 to C07, that is, the input end (input of the comparator) of the NOT circuit 704 has the following value through the equalization when the average value of the voltages of the sampled signal Va is a ternary value.

For example, first, when the average value of the voltages of the sampled signal Va is the voltage VLadc which is the lowest value, the voltage of the one ends of the capacitors C00 to C07 is rarely changed due to ON of the switches Sw*2 despite the fact that the voltage VLadc is applied, and thus the voltage Vn is maintained to the voltage Vth of the threshold value.

Second, when the average value of the voltages of the sampled signal Va is the voltage Vth which is the substantial center of the voltage VLadc and the voltage VHadc, a sum of the charges accumulated in the capacitors C00 to C07. Therefore, when the switches Sw*2 are turned on and thus the voltage VLadc is applied to the one ends of the capacitors C00 to C07, the voltage Vn at the other ends becomes the voltage VLadc which is the same voltage at the one ends thereof.

Third, when the average value of the voltages of the sampled signal Va is the voltage VHadc which is the highest value, the voltage at the one ends of the capacitors C00 to C07 is lowered from the voltage VHadc to the voltage VLadc by turning on switch Sw*2. Therefore, the voltage Vn at the other ends is further lowered from the voltage Vth by |VHadc−VLadc|.

In FIG. 20, a scale (voltage scale) in the vertical direction of the input of the comparator is set to be different from a scale in the vertical direction of another signal which is a logic signal for the description. In the drawing, * indicates that the scale in the vertical direction is different from another (the same applied to FIG. 22 to be described below).

In the first example, since the sequential conversion type is set, the overview of the AD conversion after the equalization is as follows.

First, the voltage Vn based on a sum of the charges accumulated in four capacitors which are half of the capacitors C00 to C07 is determined to be less than the voltage Vth which is a median value of the full scale (steps S1 and S2).

Second, two capacitors to be used for comparison are added (+2) or subtracted (−2) according to the determination result, and the voltage Vn based on the sum of the charges is determined to be less than the voltage Vth (steps S3 and S4 or steps S13 and S14).

Third, one capacitor to be used for the comparison is added (+1) or subtracted (−1) according to the determination result, and the voltage Vn based on the sum of the charges is determined to be less than the voltage Vth (steps S5 and S6, steps S9 and S10, steps S15 and S16, or steps S19 and S20).

A specific operation will be described with reference to FIG. 20.

At time T11 after time T10, the switches Sw02, Sw12, Sw22, and Sw32 are controlled to be turned off, the switches Sw03, Sw13, Sw23, and Sw33 are controlled to be turned on, and ON/OFF of the other switches are maintained (step S1).

Thus, of the equalized eight capacitors C00 to C07, the voltage at the one end of each of the four capacitors C00 to C03 can be increased from the voltage VLadc to the voltage VHadc. However, since the one end of each of the four remaining capacitors C04 to C07 remains at the voltage VLadc, the voltage Vn at the commonly connected other ends is increased by a value according to the charges accumulated in the four capacitors in the equalized charges of the eight capacitors as a redistribution result of the charges in the capacitors C00 to C07.

The voltage at this time has the following value when the foregoing ternary value is used as an example.

That is, first, when the average value of the voltages of the sampled signal Va is the voltage VLadc which is the lowest value and the voltage Vn before change is the voltage Vth, the voltage at the one ends of four capacitors among the eight capacitors is increased from the voltage VLadc to the voltage VHadc. Therefore, the voltage Vn after the change becomes the voltage VHadc at a point internally divided at 1:1 between the voltage Vth which is the voltage before the change and a voltage (Vth+VHadc) increased from the voltage Vth. Second, when the average value of the voltages of the sampled signal Va is the voltage Vth which is the median value and the voltage Vn before the change is the voltage VLadc, the voltage Vn after the change becomes the voltage Vth at a point internally divided at 1:1 between the voltage VLadc which is the voltage before the change and the voltage VHadc increased from the voltage VLadc. Third, when the average value of the voltages of the sampled signal Va is the voltage VHadc which is the highest value and the voltage Vn before the change is decreased by |VHadc−Vth| from the voltage VLadc, the voltage Vn before the change becomes the voltage VLadc at a point internally divided at 1:1 between the voltage VHadc which is the voltage before the change and the voltage Vth increased from the voltage VHadc.

Here, after time T11 (before time T12), the timing controller 720 instructs the latch circuit 713 to latch an output signal (output of the comparator) of the NOT circuit 704. The latch circuit 713 latches the output of the comparator in response to the instruction.

The output signal of the latch circuit 713 is a signal which is "1" when the voltage Vn after the redistribution of the charges due to the increase in the voltage VHadc at the one ends of the four capacitors is less than the voltage Vth and is "0" when the voltage Vn is equal to or greater than the voltage Vth. The output signal becomes the MSB in the data Do.

In the example of FIG. 20, since the voltage Vn after time T11 is less than the voltage Vth and the MSB is "1," that is, the determination result of step S2 is "YES," the control circuit 720 controls ON/OFF of the switches as follows according to the determination result. That is, at time T12 after time T11, the control circuit 720 performs the control such that the switches Sw42 and Sw52 are turned off and the switches Sw43 and Sw53 are turned on (step S3). Thus, the voltage VHadc is applied to the one ends of the total of six capacitors, that is, two capacitors C04 and C05 in addition to the four capacitors.

On the other hand, after time T12 (before time T13), the timing controller 720 instructs the latch circuit 712 to latch the output of the comparator. The latch circuit 712 latches the output of the comparator in response to the instruction.

The output signal of the latch circuit 712 is a signal obtained by latching the output of the comparator after time T12. This signal becomes the 2SB in the data Do.

In this example, since the voltage Vn after time T12 is equal to or greater than the voltage Vth and the 2SB is "0," that is, the determination result of step S4 is "No," the control circuit 720 controls ON/OFF of the switches as follows according to the determination result. That is, at time T13 after time T12, the control circuit 720 performs the control such that the switches Sw42 and Sw52 are turned on back and the switches Sw43 and Sw53 are turned off back and performs the control such that the switch Sw62 is turned off and the switch Sw63 is turned on (step S9). Thus, the voltage at the one ends of the two capacitors C04 and C05 added in the foregoing step S3 among the six capacitors is returned to the voltage VLadc and, on the other hand, the voltage at the one end of the other one capacitor C06 is switched from the voltage VLadc to the voltage VHadc.

On the other hand after time T13, the timing controller 720 instructs the latch circuit 711 to latch the output of the comparator. The latch circuit 711 latches the output of the comparator in response to the instruction.

The output signal of the latch circuit 711 is a signal obtained by latching the output of the comparator after time T13. This signal becomes the LSB in the data Do.

In this example, since the voltage Vn after time T13 is less than the voltage Vth and the LSB is "1," that is, the determination result of step S10 is "YES," the signals latches by the latch circuits 713, 712 and 711, that is, the data Do, become "101" (step S11).

Here, the case in which the steps in FIG. 19 follow the route of (S0)→S1→S2→S3→S4→S9→S10→S11 has been exemplified. However, different routes are followed according to determination results of three stages.

For example, when the voltage Vn is equal to or greater than the voltage Vth in step S10, the determination result is "NO" and the LSB is "0." Therefore, the data Do latched by the latch circuits 713, 712, and 711 becomes "100" (step S12).

When the voltage Vn is less than the voltage Vth in step S4, the determination result is "YES" and the 2SB becomes "1." Therefore, the control circuit 720 performs the control such that the switches Sw42 and Sw52 are maintained to be off and the switches Sw43 and Se53 are maintained to be on, and then the switch Sw62 is turned off and the switch Sw63 is turned on after time T13 (step S5). Thus, the voltage at the one ends of the two capacitors C04 and C05 added in the foregoing step S3 among the four capacitors is maintained to the voltage VHadc, and then the voltage at the one end of the other one capacitor C06 is switched from the voltage VLadc to the voltage VHadc.

When the voltage Vn is equal to or greater than the voltage Vth in step S2, and the determination result is "NO" and the MSB becomes "0." Therefore, the control circuit 720 performs the control such that the switches Sw02, Sw12, Sw22, and Sw32 are turned on back and the switches Sw03, Sw13, Sw23, and Sw33 are turned off back, and then the switches Sw42 and Sw52 are turned off and the switches Sw43 and Sw53 are turned on after time T12 (step S13). Thus, the voltage at the one ends of the four capacitors C00 to C03 is returned to the voltage VLadc, and then the voltage at the one ends of the other two capacitors C04 and C06 is switched from the voltage VLadc to the voltage VHadc.

Thus, in the first example, the data Do is decided according to the determination results of the three stages illustrated in FIG. 19.

Here, an example of the AD conversion by the ADC 700 will be described.

As described above, the ADC 700 outputs 3 bits to indicate at which position (level) the voltage of the signal Va is present in a voltage range from the voltage VHadc of the high side to the voltage VLadc of the low side.

Figures 25A, 25B:
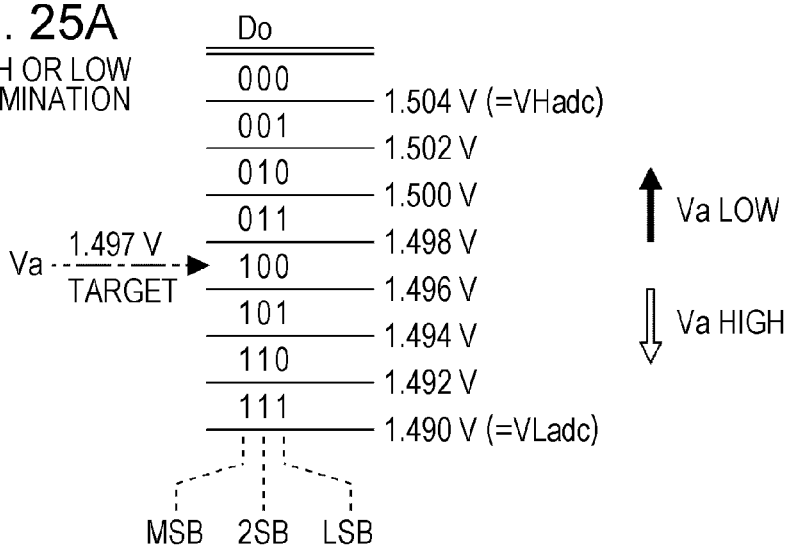
FIGS. 25A and 25B are diagrams illustrating a setting operation of a high-side correction mode in the operation mode.

For example, when the conversion controller 750 sets the voltage VHadc and the voltage VLadc to 1.504 and 1.490, respectively, the data Do is converted in regard to the voltage of the signal Va, as illustrated in FIG. 25A. Accordingly, in this case, when the voltage of the signal Va is 1.497 volts, the data Do is output as "100."

Figures 26A, 26B:
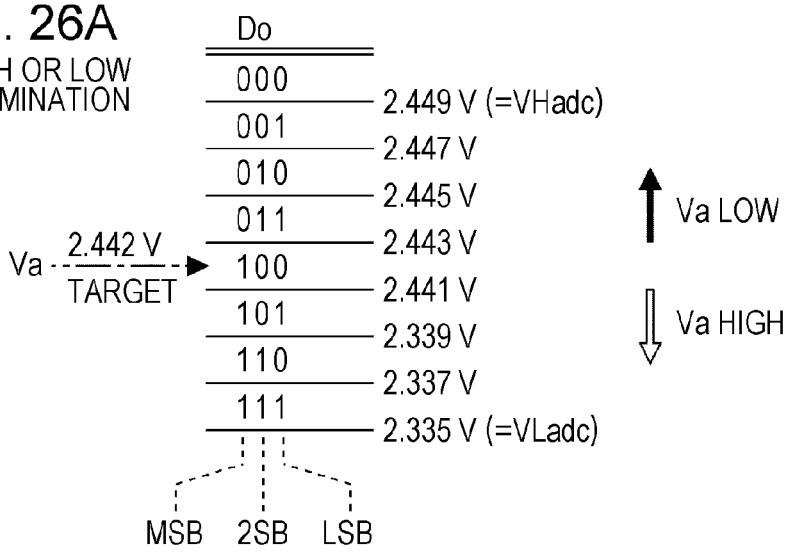
FIGS. 26A and 26B are diagrams illustrating a setting operation of a low-side correction mode in the operation mode.

For example, when the conversion controller 750 sets the voltage VHadc and the voltage VLadc to 2.449 and 2.335, respectively, the data Do is converted in regard to the voltage of the signal Va, as illustrated in FIG. 26A. Accordingly, in this case, when the voltage of the signal Va is 2.442 volts, the data Do is output as "100."

The ADC 700 equalizes the voltages (the charges according to the voltages) of the signal Va sampled sequentially at the temporally different points (eight points in the example of FIG. 16) in the capacitors C00 to C07 with substantially the same capacitance when the switches Sw*2 are turned on at time T10, and then the performs the AD conversion based on the equalized charges.

Therefore, compared to a configuration in which the AD conversion is performed on voltages sampled a plurality of times and an average value of the AD conversion results is obtained through calculation, the calculation is not necessary in the ADC 700. Thus to that extent, it is possible to shorten the total time until the average value obtained from the sampling is output.

Since the ripples are assumed to remain in the signal to be subjected to the AD conversion, the ADC 700 equalizes the voltages sampled a plurality of times. Therefore, in the embodiment, an LPF reducing the ripples of the signal to be converted is not necessary at the front stage of the ADC 700.

The non-necessity of the LPF will be described in detail. In order to sufficiently reduce ripples of a signal to be converted, an LPF with large capacitance, a resistor, and an inductor are necessary. In order to integrate the LPF, the resistor, and the inductor as an LSI, the area of a die (chip) may increase, that is, cost may increase. When the LSI is an externally attached component, the area of the die can be prevented from increasing. However, an entire circuit having an area in which the externally attached component is mounted may not be prevented from being enlarged or the cost may not be prevented from increasing. When the LPF is installed, a waiting time until sampling of a signal to be converted is necessary.

In the embodiment, since it is not necessary to installed an LPF at the front stage of the ADC 700, it is easy to realize miniaturization by the integration of the LSI and decrease the cost. Further, the waiting time can also be unnecessary.

In the embodiment, the integral attenuator 512 which is a kind of LPF is installed at the front stage of the ADC 700. However, the reason why the integral attenuator 512 is installed is to match the voltage of the driving signal COM-A with the output voltage of the DAC 800 and delay is necessary to some extent in the self-excited oscillation of the class D amplification, as described above. Therefore, the presence of the integral attenuator 512 may apparently be neglected focusing on the function of the AD conversion by the ADC 700.

The sequential conversion type has been exemplified in regard to the above-described ADC 700, but another type such as a ramp waveform comparison type may be used. Accordingly, the ramp waveform comparison type will be described as a second example of the ADC 700.

Figure 21:
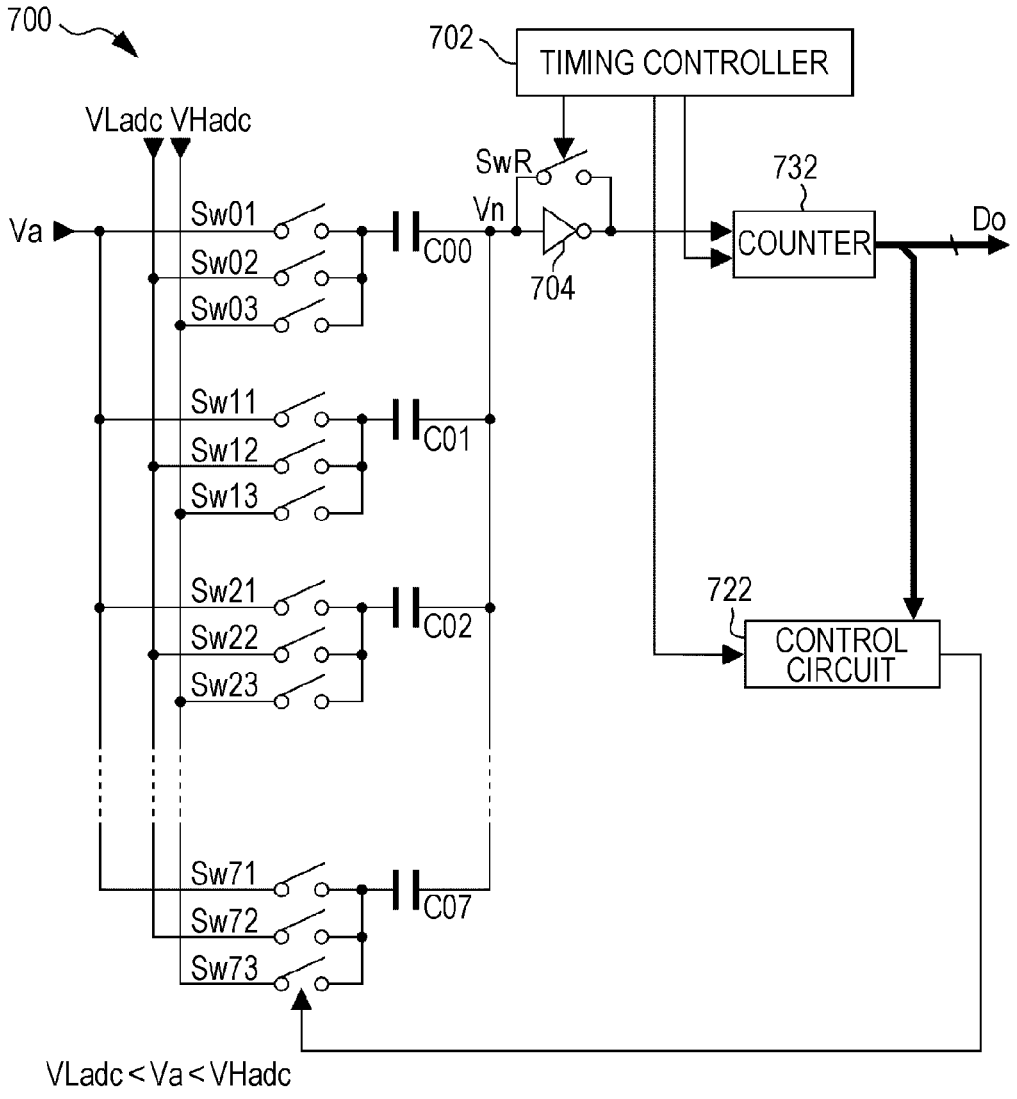
FIG. 21 is a diagram illustrating a second example of the ADC in the driving circuit.

FIG. 21 is a diagram illustrating the configuration of the ADC 700 (the second example: the ramp waveform comparison type).

The second example illustrated in the drawing is different from the first example illustrated in FIG. 16 after the output end of the NOT circuit 704 which is the comparator. Thus, the second example will be described focusing on the differences.

In the second example, a counter 732 is installed instead of the latch circuits and a control circuit 722 is configured to separately control ON/OFF of the switches Sw*1, Sw*2, and Sw*3 according to an output of the counter 732. The counter 732 counts up count results from an initial value "0" ("000") to "7" ("111") in response to an instruction of the timing controller 702 and outputs, as the data Do, a count result when the output signal of the NOT circuit 704 is changed from the H level to the L level.

An operation during a sampling period in the second example is the same as that during the sampling period (see FIG. 17) in the first example. Therefore, in the second example, the description will be described focusing on the operation during the AD conversion period.

Figure 22:
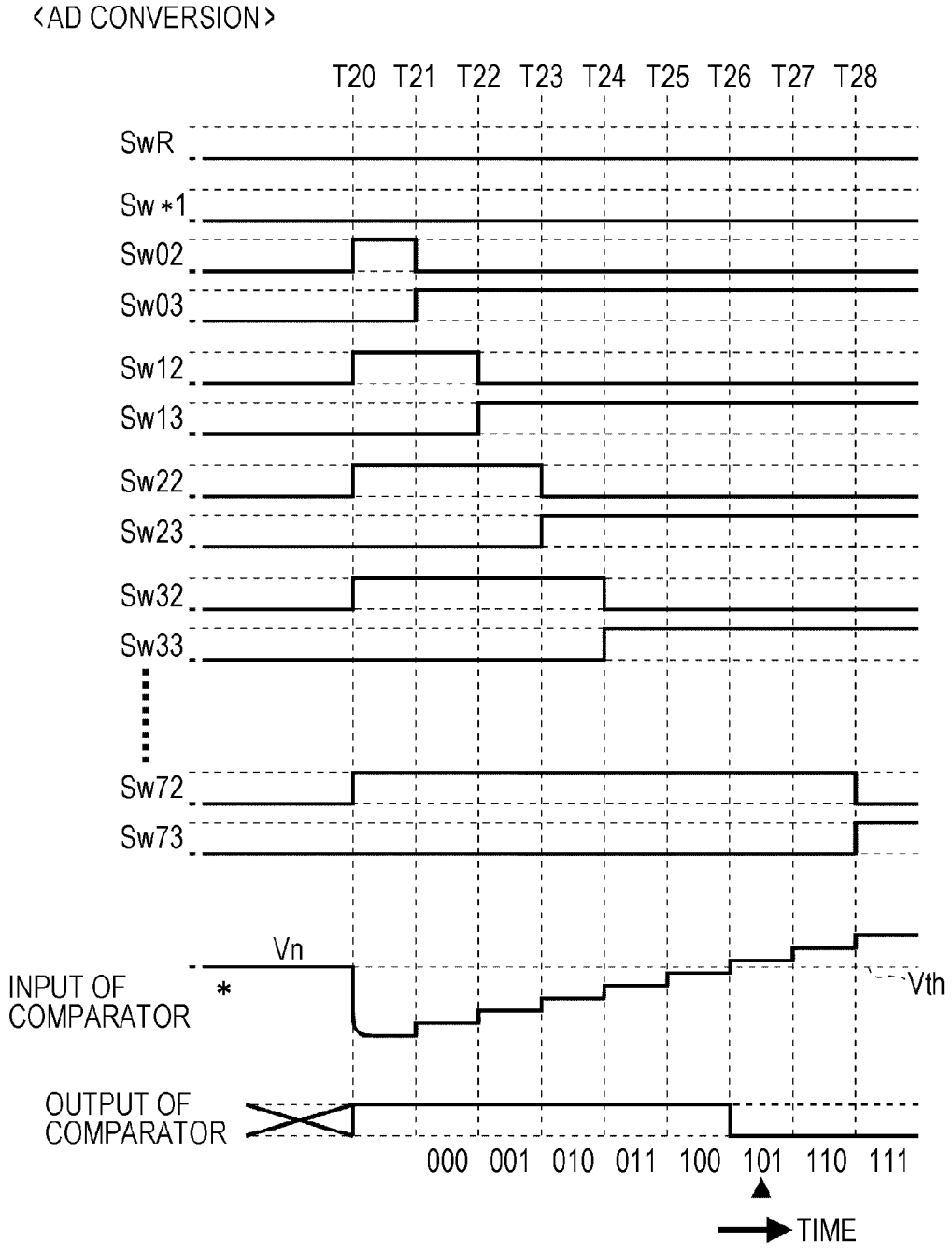
FIG. 22 is a timing chart illustrating an AD conversion operation in the second example.

FIG. 22 is a timing chart illustrating an example of the operation during the AD conversion period in the second example with ON/OFF of each switch.

First, the switches Sw*2 are controlled to be turned on at time T20 after time T9 during the sampling period. The second example is the same as the first example in that the switches SwR and Sw*3 are maintained to be off during the whole of the AD conversion period.

When the switches Sw*2 are turned on at time T20, the voltage VLadc of the low side is applied to the one end of each of the capacitors C00 to C07. Therefore, the charges according to the voltages sampled in the capacitors C00 to C07 are held in a state equalized using the voltage VLadc as a criterion. Therefore, the voltage Vn at the input end (input of the comparator) of the NOT circuit 704 is the voltage according to the equalized charges.

In the second example, at time T21 after time T20, the timing controller 702 instructs the control circuit 722 to enter each switch into the following state.

In response to the instruction, the control circuit 722 performs the control such that the switch Sw02 is turned off and the switch Sw03 is turned on. Thus, of the capacitors C00 to C07 of which the charges are equalized, the voltage at the one end of the capacitor C00 is switched from the voltage VLadc to the voltage VHadc. However, since the one end of each of the seven remaining capacitors C01 to C07 remains at the voltage VLadc, the voltage Vn at the commonly connected other ends is increased by a value according to the charges accumulated in one capacitor in the equalized charges of the eight capacitors as a redistribution result of the charges in the capacitors C00 to C07.

At time T21, the timing controller 702 instructs the counter 732 to reset the count result. From this, the count result of the counter 732 is reset to "0" ("000").

Next, at time T22 after time T21, the timing controller 702 instructs the control circuit 722 to enter each switch into the following state.

In response to the instruction, the control circuit 722 performs the control such that the switch Sw12 is turned off and the switch Sw13 is turned on. Thus, of the capacitors C00 of which the charges are equalized, the voltage at the one end of the capacitor C01 is switched from the voltage VLadc to the voltage VHadc. That is, the cumulative number of capacitors of which the one ends are switched to the voltage VHadc is assumed to be "2."

At time T22, the timing controller 702 instructs the counter 732 to count up the count results. From this, the count result of the counter 732 becomes "1" ("001").

Subsequently, the control is similarly preformed such that the switch Sw22 is turned off and the switch Sw23 is turned on at time T23, the switch Sw32 is turned off and the switch Sw33 is turned on at time T24, the switch Sw42 is turned off and the switch Sw43 is turned on at time T25, the switch Sw52 is turned off and the switch Sw53 is turned on at time T26, the switch Sw62 is turned off and the switch Sw63 is turned on at time T27, and the switch Sw72 is turned off and the switch Sw73 is turned on at time T28. Thus, the cumulative number of capacitors of which the one ends are switched to the voltage VHadc is "1" and the cumulative number of capacitors finally increases up to "8."

At time T23 to time T28, the count result of the counter 732 is counted up by "1" and the count results become "2" ("010") to "7" ("111"), respectively.

On the other hand, the voltage Vn at the common connection point of the other ends of the capacitors C00 to C07, that is, the input end (input of the comparator) of the NOT circuit 704, is increased step by step from the equalized voltages at time T20, as illustrated in the drawing, whenever the cumulative number of capacitors of which the one ends are switched to the voltage VHadc is increased by "1."

When the voltage Vn is equal to or greater than the voltage Vth during the stepwise increase in the voltage Vn, the output end (output of the comparator) of the NOT circuit 704 is reversed to become the L level. The counter 732 outputs, as the data Do, the count result when the output of the comparator is changed to the L level.

For example, as illustrated in FIG. 22, when the output of the comparator is changed to the L level after time T26 (before time T27), the data Do becomes "5" ("101").

When the output of the comparator is changed in eight steps of 3 bits and is compared to the voltage Vth at each change time as in the second example, the AD conversion period is lengthened more than in the sequential conversion type of the first example. However, since it is not necessary to perform the branching process according to the determination illustrated in the flowchart of FIG. 19, the circuit can be simplified and reduced in size.

In both of the first example and the second example, the eight capacitors C00 to C07 for the sampling and the maintenance have been used for the output of 3 bits. However, the number of capacitors can, of course, be modified appropriately according to the output bits.

Next, the DAC 800 in the driving circuit 50 will be described.

Figure 23:
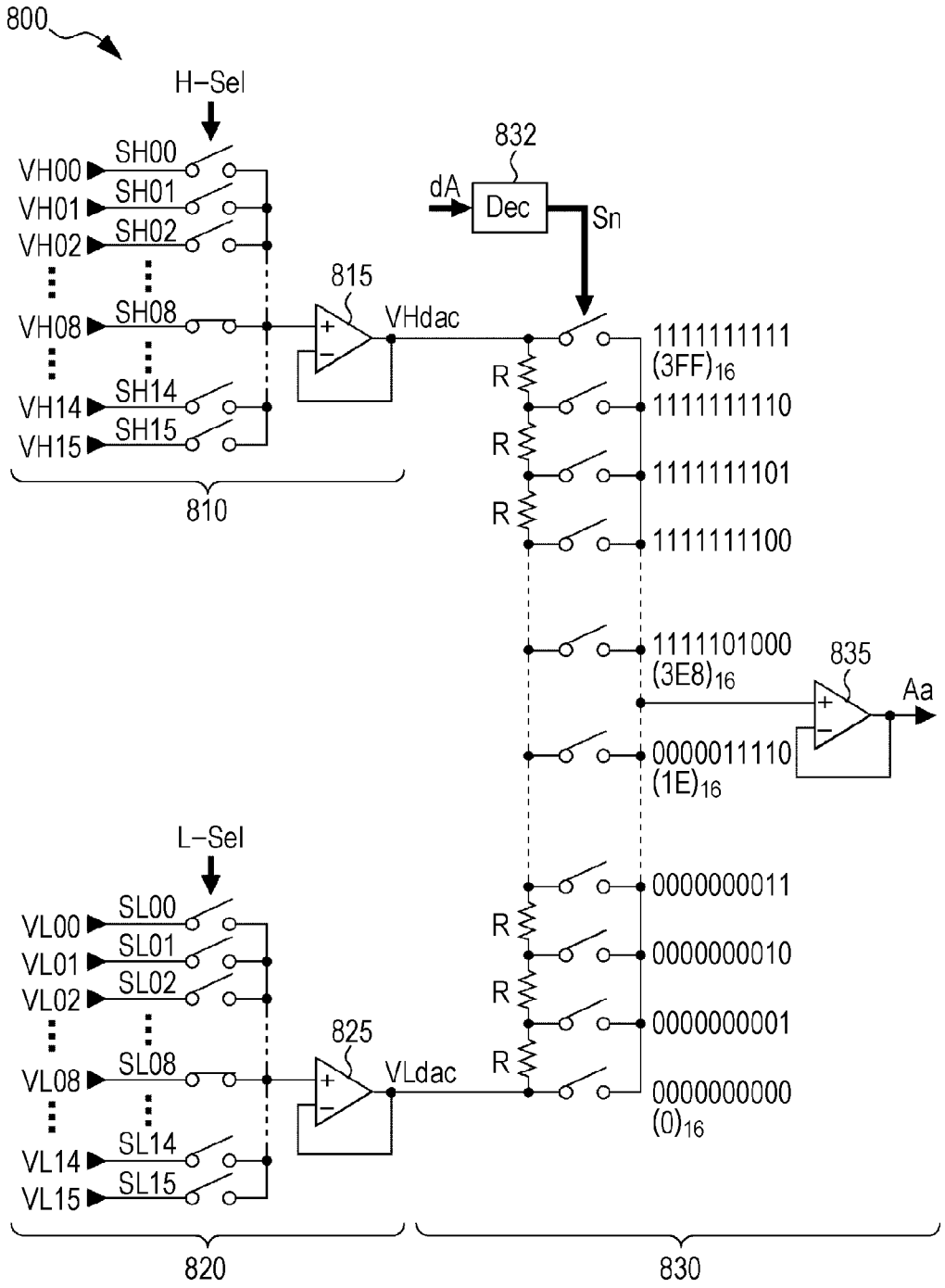
FIG. 23 is a diagram illustrating a DAC in the driving circuit.

FIG. 23 is a diagram illustrating the configuration of the DAC 800.

As illustrated in the drawing, the DAC 800 includes a voltage output circuit 810 that outputs the voltage VHdac of the high side, a voltage output circuit 820 that outputs the voltage VLdac of the low side, and a conversion unit 830 that converts 10-bit waveform data dA supplied from the control unit 100 (see FIG. 10) into an analog voltage.

A DAC is generally said to convert input digital data into an analog signal and output the analog signal. However, in this description, it is meant that the DAC includes a mechanism that defines the upper limit (voltage) of the analog signal with a control signal H-Sel and defines the lower limit of the analog signal with a control signal L-Sel.

The voltage output circuit 810 is not partially illustrated. The voltage output circuit 810 is configured to include switches SH00 to SH15 for which voltages VH00 to VH15 are sequentially applied to one ends and the other ends are commonly connected and a non-inverting amplification circuit 815 that amplifies the voltage at the commonly connected other ends by one time and outputs the voltage as the voltage VHdac. Here, of the switches SH00 to SH15, a switch designated by the control signal H-Sel is turned on. Therefore, the non-inverting amplification circuit 815 is configured to output the voltage applied to one end of the switch which has been turned on as the voltage VHdac.

The voltages VH00 to VH15 are generated by a power circuit (not illustrated) and are set to have, for example, the values as illustrated in FIG. 25B. That is, the voltage VH00 is se to 2.016 volts and the voltages VH01 to VH15 are set as voltages decreased at intervals of 0.002 volts step by step from the voltage VH00.

To facilitate the description, a state in which the switch corresponding to the voltage VH08 is turned on by the control signal H-Sel is assumed to be an initial set state. That is, the initial set value of the voltage VHdac is assumed to be 2.000 volts. For the switches SH00 to SH15, the switch for which a voltage applied to one end is higher is referred to as being at a higher rank (the switch for which a voltage applied to one end is lower is at a lower rank) in some cases for convenience.

The voltage output circuit 820 has substantially the same as the voltage output circuit 810. Specifically, the voltage output circuit 820 is configured to include switches SL00 to SL15 for which voltages VL00 to VL15 are sequentially applied to one ends and the other ends are commonly connected and a non-inverting amplification circuit 825 that amplifies the voltage at the commonly connected other ends by one time and outputs the voltage as the voltage VLdac. Here, of the switches SL00 to SL15, a switch designated by the control signal L-Sel is turned on. Therefore, the non-inverting amplification circuit 825 is configured to output the voltage applied to one end of the switch which has been turned on as the voltage VLdac.

The voltages VH00 to VH15 are generated by the foregoing power supply circuit and are set to have, for example, the values as illustrated in FIG. 26B. That is, the voltage VL00 is set to 1.016 volts and the voltages VL01 to VL15 are set as voltages decreased at intervals of 0.002 volts step by step from the voltage VL00.

To facilitate the description, a state in which the switch corresponding to the voltage VL08 is turned on by the control signal L-Sel is assumed to be an initial set state. That is, the initial set value of the voltage VLdac is assumed to be 1.000 volts. For the switches SL00 to SL15, the switch for which a voltage applied to one end is higher is referred to as being at a higher rank (the switch for which a voltage applied to one end is lower is at a lower rank) in some cases for convenience, as in the switches SH00 to SH15.

The conversion unit 830 includes a plurality of resistors, a plurality of switches, a decoder (denoted by "Dec") 832, and a non-inverting amplification circuit 835.

Specifically, 1023 ($=2^{10}-1$) resistors with a resistance value R are connected in series from the output end of the non-inverting amplification circuit 815 to the output end non-inverting amplification circuit 825. The one ends of the switches are connected to connection points of the resistors connected in series and the other ends of the switches are commonly connected to each other. The number of switches is 1024 since the number of switches is greater than the number of resistors by "1."

The 1024 switches correspond to a descending order when the 10 bit waveform data dA is expressed in the binary notation from the output end of the non-inverting amplification circuit 815 to the output end of the non-inverting amplification circuit 825. The decoder 832 decodes the waveform data dA and performs control such that the switches corresponding to the decoding result are turned on. For example, when the waveform data dA is "0000011110," the decoder 832 counts like 1, 2, 3, etc. from the output end side of the non-inverting amplification circuit 825 and turns on only the 31st switch (denoted by $(1E)_{16}$ in FIG. 23). For example, when the waveform data dA is "1111101000," the decoder 832 counts from the output end side of the non-inverting amplification circuit 825 and turns on only the 1001st switch (denoted by $(3E8)_{16}$ in FIG. 23).

The non-inverting amplification circuit 835 amplifies the voltage at the commonly connected other ends of the 1024 switches by one time and outputs the amplified voltage as the signal Aa.

In the DAC 800, a voltage corresponding to the waveform data dA among the voltages divided by 1024 from a voltage range from the voltage VHdac to the voltage VLdac is output as the signal Aa. In other words, the signal Aa is a voltage corresponding to a descending order of the value indicated by the waveform data dA among the voltages decreased at 1024 steps of 10 bits within a voltage range in which the upper limit is the voltage VHdac and the lower limit is the voltage VLdac.

Therefore, when the switches SH00 to SH15 to be turned on are switched and the voltage VHdac is changed, the upper limit of the voltage range output by the DAC 800 is also changed. On the other hand, when the switches SL00 to SL15 to be turned on are switched and the voltage VLdac is changed, the lower limit of the voltage range output by the DAC 800 is also changed. That is, the voltage of the signal Aa corresponding to the waveform data dA can be corrected (adjusted) by changing the voltages VHdac and VLdac. Accordingly, the voltage VHdac corresponds to a first adjusted potential among adjusted potentials and the voltage VLdac corresponds to a second adjusted potential among the adjusted potentials.

Here, before voltage correction of the DAC 800 is described, a relation among the amplitudes of the signal Aa which is an output of the DAC 800, the driving signal COM-A obtained from the signal Aa through the class D amplification, and the signal Va integrated and attenuated from the feedback signal of the driving signal COM-A will be described.

Figure 24:
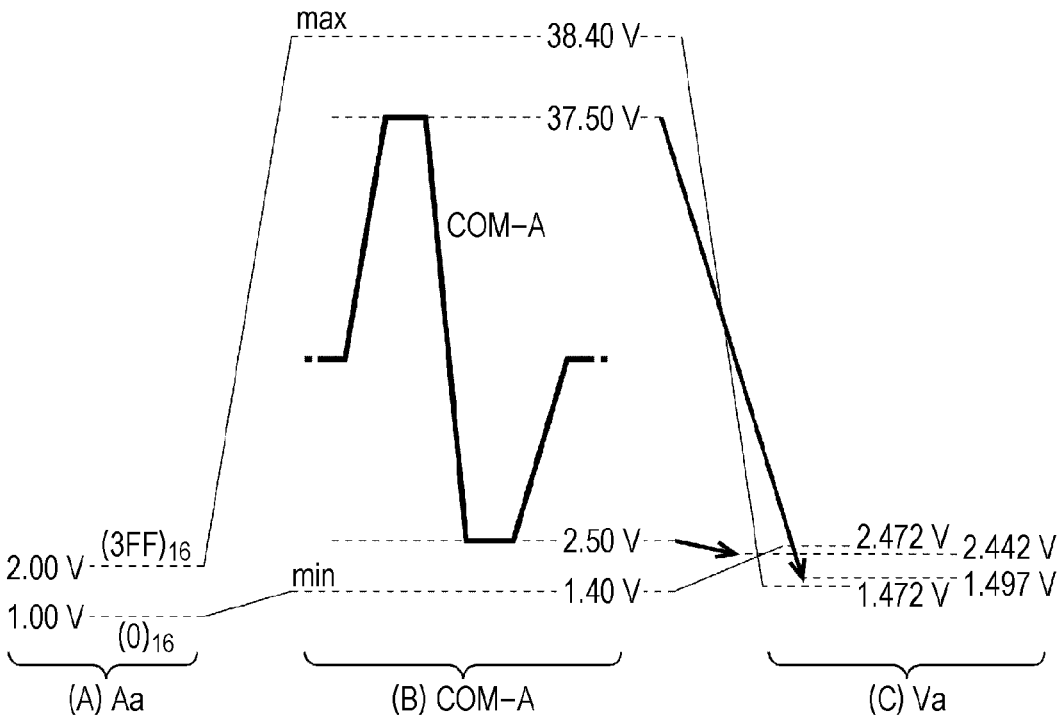
FIG. 24 is a diagram illustrating a correspondence relation between voltages in the driving circuit.

FIG. 24 is a diagram illustrating the relation among the amplitudes of the signal Aa, the driving signal COM-A, and the signal Va.

As described above, since the initial set value of the voltage VLdac is assumed to be 1.000 volt and the initial set value of the voltage VHdac is assumed to be 2.000 volts, the voltage amplitude of the signal Aa is in the range of 1.000 volt to 2.000 volts, as indicated in part (a), in the initial setting.

A relation between the voltage amplitude of the signal Aa and the waveform data dA is as follows. That is, the voltage of the signal Aa is 1.000 volt when the waveform data dA is $(0)_{16}$ which is the lowest value in the hexadecimal notation. The voltage of the signal Aa is 2.000 volts when the waveform data dA is $(3FF)_{16}$ which is the highest value with 10 bits.

In regard to the voltage amplitude of the signal Aa, the voltage of the terminal Out is subjected to the class D amplification based on the relation illustrated in part (b) of the drawing. That is, the class D amplification is performed so that the lowest value of the terminal Out is 1.400 volts serving as the lowest value when the signal Aa is 1.000 volt serving as the lowest value, and the highest value of the terminal Out is 38.40 volts serving as the highest value when the signal Aa is 2.000 volts serving as the upper limit.

For the terminal Out (voltage Vf), the voltage Va of the output signal of the integral attenuator 512 has been described in Expression (1) above. Therefore, when the terminal Out is 1.400 volts serving as the lowest value, as indicated in part (C) of the drawing, the voltage of the signal Va is 2.472 volts. When the terminal Out is 38.40 volts serving as the highest value, the voltage of the signal Va is 1.472 volts. Since the integral attenuator 512 is an inverting amplifier, as illustrated in FIG. 11, the lowest value (highest value) of the terminal Out has the relation of the highest value (the lowest value) of the signal Va.

Incidentally, as illustrated in the drawing, the voltage amplitude of the driving signal COM-A does not cover the whole range from the lowest value to the highest value in the terminal Out. That is, in the example of the drawing, the highest value and the lowest value of the driving signal COM-A are set to 37.50 volts and 2.500 volts, respectively.

Since the voltage range of the terminal Out is 1.400 volts to 38.40 volts and is 37.00 volts in terms of the amplitude from the lowest value to the highest value, the voltage in this range (amplitude) is defined by the 10-bit waveform data dA.

Here, 37.50 volts serving as the highest value of the driving signal COM-A is a voltage which is higher by 36.10 volts from 1.400 volts of $(0)_{16}$, and this voltage corresponds to $(3E8)_{16}$ ("1000" in the decimal notation) in the waveform data dA.

Further, 2.50 volts serving as the lowest value of the driving signal COM-A is a voltage which is higher by 1.100 volts from 1.400 volts corresponding to $(0)_{16}$ of the waveform data dA, and 1.100 volts corresponds to $(1E)_{16}$ ("30" in the decimal notation) in the waveform data dA.

When the driving signal COM-A is 37.50 volts serving as the highest value, the voltage of the signal Va becomes 1.497 volts according to Expression (1) above. On the other hand, when the driving signal COM-A is 2.500 volts serving as the lowest value, the driving signal COM-A is feedback and the voltage of the integrated and attenuated signal Va becomes 2.442 volts according to Expression (1) above.

Since the driving signal COM-A is accompanied with the ripples because of self-excited oscillation, as described above, 37.50 and 2.500 volts of this case each mean the average values. In the embodiment, as described above, the ADC 700 samples the voltages of the signal Va attenuated from the driving signal COM-A at eight points and outputs the average value of the voltages as the data Do, and thus the accuracy of the AD conversion of the signal accompanied with the ripples is high.

When $(3E8)_{16}$ supplied as the waveform data dA is converted into the analog signal Aa in the driving circuit 50 and the data Do indicates that the average value of the voltages of the signal Va obtained by the feedback of the output signal from the terminal Out is 1.497 volts based on the signal Aa, the average value of the driving signal COM-A in which the ripples remain is correct and is output as 37.50 volts.

In view of the range of $(0)_{16}$ to $(3FF)_{16}$ of the waveform data dA, $(3E8)_{16}$ can be considered to be substantially the same as $(3FF)_{16}$.

Therefore, in the correction mode, the voltage VHdac may be adjusted in the DAC 800 so that the voltage of the signal Va based on the signal Aa output by performing the analog conversion on $(3E8)_{16}$ as the waveform data dA becomes 1.497 volts.

When $(1E)_{16}$ supplied as the waveform data dA is converted into the analog signal Aa in the driving circuit 50 and the data Do indicates that the average value of the voltages of the signal Va obtained by the feedback of the output signal from the terminal Out is 2.442 volts based on the signal Aa, the average value of the driving signal COM-A accompanied with the ripples is correct and is output as 2.500 volts.

The voltage VLdac is defined as the lower limit of the signal Aa output from the DAC 800 and the voltage VHdac is defined as the upper limit thereof. However, in view of the range of $(0)_{16}$ to $(3FF)_{16}$ of the waveform data dA, $(1E)_{16}$ can be considered to be substantially the same as $(0)_{16}$.

Therefore, in the correction mode, the voltage VLdac may be adjusted in the DAC 800 so that the voltage of the signal Va based on the signal Aa output by performing the analog conversion on $(1E)_{16}$ as the waveform data dA becomes 2.442 volts.

The overview of the operation in the correction mode has been described.

In the correction mode, as illustrated in FIG. 12, the low-side correction mode is first performed, and the high-side correction mode is subsequently performed. However, when the correction mode is performed first after power activation, the conversion controller 750 instructs the DAC 800 to turn on the switch SH08 using the control signal H-Sel and instructs to turn on the switch SL08 using the control signal L-Sl. Thus, in the DAC 800, the voltage output unit 810 outputs the voltage VH08 (=2.000 volts) as the voltage VHdac and the voltage output unit 820 outputs the voltage VL08 (=1.000 volt) as the voltage VLdac. That is, the voltage VHdac is set as an initial set value to 2.000 volts and the voltage VLdac is set as an initial set value to 1.000 volts.

When the correction mode is performed first in this way, the initial setting of the voltages VHdac and VLdac is performed. When the sleep mode transitions to the correction mode after the ejection mode, some switches can be instructed to be turned on among the switches SH00 to SH15 and the switches SL00 to SL15.

Next, the high-side correction mode performed first in the correction mode will be described.

In high-side correction mode, the control unit 100 supplies $(3E8)_{16}$ as the waveform data dA to the driving circuit 50 and notifies the driving circuit 50 that the high-side correction mode is set using the control data Actr.

When the driving circuit 50 is notified of the high-side correction mode, the conversion controller 750 set the following voltages VHadc and VLadc for the ADC 700 as follows in correction (1) of the high-side correction mode, that is, the first correction. That is, the conversion controller 750 sets the voltage VHadc for the ADC 700 to 1.504 volts and sets the voltage VLadc to 1.490 volts. The reason why the voltages VHadc and VLadc are set in this way is mainly the following two.

That is, the first reason is to set a target voltage (1.497 volts) of the signal Va to be converted by the ADC 700 at the center of a voltage range decided with the voltages VHadc and VLadc when $(3E8)_{16}$ is supplied as the waveform data dA in the high-side correction mode.

The second reason is to arrange a voltage range corresponding to one piece at 0.002 volts which is an interval of the voltage in regard to the voltages VH00 to VH15 when the voltage range decided with the voltages VHadc and VLadc is divided into eight pieces corresponding to 3 bits.

The DAC 800 supplied with $(3E8)_{16}$ as the waveform data dA converts the waveform data dA into the analog signal Aa and outputs the analog signal Aa. Therefore, the driving signal subjected to the class D amplification is output from the terminal Out by the self-excited oscillation. The driving signal is feedback via the pin Vfb and is attenuated by the integral attenuator 512 to become the signal Va.

The ADC 700 samples the signal Va at the eight points during the sampling period of correction (1) and outputs the data Do obtained by performing the AD conversion on the average value of the voltages during the continuous AD conversion period.

Here, when the average value of the voltages of the signal Va is the target voltage (=1.497 volts), as illustrated in FIG. 25A, this voltage is the substantial center of the range from 1.504 volts corresponding to "000" to 1.490 volts corresponding to "111," and thus the data Do is "100."

However, for example, when the voltage of the signal Va is higher than the target voltage due to a variation in the inductance of the inductor L2, the reasons to be described, or the like, the data Do is less than "100." In this case, the average value of the voltages of the driving signal output from the terminal Out means to be less than 37.50 volts. Conversely, when the voltage of the signal Va is less than the target voltage, the data Do is greater than "100." In this case, the average value of the voltages of the driving signal output from the terminal Out means to be greater than 37.50 volts.

Accordingly, the conversion controller 750 controls the states of the switches SH00 to SH15 during the VHdac change period as follows according to the data Do during the AD conversion period. That is, when the data Do is the target "100," the conversion controller 750 does not change the switches to be turned on among the switches SH00 to SH15. When the data Do is less than "100," the conversion controller 750 increases the switches to be turned on by one rank among the switches SH00 to SH15. When the data Do is greater than "100," the conversion controller 750 decreases the switches to be turned on by one rank among the switches SH00 to SH15.

Thus, when the data Do is "100," the switches to be turned on among the switches SH00 to SH15 are not changed. When the data Do is less than "100," the voltage VHdac is increased by 0.002 volts corresponding to one rank, and thus the control is performed in a direction in which the highest voltage of the driving signal COM-A increases. Conversely, when the data Do is greater than "100," the voltage VHdac is considered to be low by 0.002 volts, and thus the control is performed in a direction in which the highest voltage of the driving signal COM-A decreases.

The same operation as that of correction (1) is repeated from correction (2) to correction (8). That is, the operation of correcting the voltage VHdac according to the data Do is repeated a total of eight times. Thus, the voltage VHdac is adjusted so that the average value of the voltages of the signal Aa becomes the target 1.497.

In the first correction (1), when the data Do obtained by performing the AD conversion on the signal Va is "000," the voltage VHdac can be switched from the voltage VH08 to the voltage VH07. In correction (2), the voltage VHdac can be switched to the voltage VH06. In correction (3), the voltage VHdac can be switched to the voltage VH05. In correction (4), the voltage VHdac can be switched to the voltage VH04. At this time, the data Do becomes "100," and thus the voltage is considered not to be switched after correction (5). However, a margin is set after correction (5).

Next, the low-side correction mode to be performed after the high-side correction mode will be described.

In the low-side correction mode, the control unit 100 supplies $(1E)_{16}$ as the waveform data dA to the driving circuit 50 and notifies the driving circuit 50 that the low-side correction mode is set using the control data Actr.

When the driving circuit 50 is notified of the low-side correction mode, the conversion controller 750 set the voltage VHadc for the ADC 700 to 2.449 volts and sets the voltage VLadc to 2.335 volts in correction (1) of the low-side correction mode, that is, the first correction. The reason why the voltages VHadc and VLadc are set in this way is mainly the following two.

That is, the first reason is to set a target voltage (2.442 volts) of the signal Va to be converted by the ADC 700 at the center of a voltage range decided with the voltages VHadc and VLadc when $(1E)_{16}$ is supplied as the waveform data dA in the low-side correction mode.

The second reason is to arrange a voltage range corresponding to one piece at 0.002 volts which is an interval of the voltage in regard to the voltages VL00 to VL15 when the voltage range decided with the voltages VHadc and VLadc is divided into eight pieces corresponding to 3 bits.

The voltage set in the high-side correction mode is used as the voltage VHdac in the DAC 800.

The DAC 800 supplied with $(1E)_{16}$ as the waveform data dA converts the waveform data dA into the analog signal Aa and outputs the analog signal Aa. Therefore, the driving signal subjected to the class D amplification is output from the terminal Out by the self-excited oscillation. The driving signal is feedback via the pin Vfb and is attenuated by the integral attenuator 512 to become the signal Va.

The ADC 700 samples the signal Va at the eight points during the sampling period of correction (1) and outputs the data Do obtained by performing the AD conversion on the average value of the voltages during the continuous AD conversion period.

Here, when the average value of the voltages of the signal Va is the target voltage (=2.442 volts), as illustrated in FIG. 26A, this voltage is the substantial center of the range from 2.449 volts to 2.335 volts, and thus the data Do is "100."

However, for example, when the voltage of the signal Va is higher than the target voltage due to some reasons, the data Do is less than "100." In this case, the average value of the voltages of the driving signal output from the terminal Out means to be less than 2.500 volts. Conversely, when the voltage of the signal Va is less than the target voltage, the data Do is greater than "100." In this case, the average value of the voltages of the driving signal output from the terminal Out means to be greater than 2.500 volts.

Accordingly, the conversion controller 750 controls the states of the switches SL00 to SL15 during the VLdac change period as follows according to the data Do during the AD conversion period. That is, when the data Do is the target "100," the conversion controller 750 does not change the switches to be turned on among the switches SL00 to SL15. When the data Do is less than "100," the conversion controller 750 increases the switches to be turned on by one rank among the switches SL00 to SL15. When the data Do is greater than "100," the conversion controller 750 decreases the switches to be turned on by one rank among the switches SL00 to SL15.

Thus, when the data Do is "100," the switches to be turned on among the switches SL00 to SL15 are not changed. When the data Do is less than "100," the voltage VLdac is increased by 0.002 volts corresponding to one rank, and thus the control is performed in a direction in which the lowest voltage of the driving signal COM-A increases. Conversely, when the data Do is greater than "100," the voltage VLadc is considered to be low by 0.002 volts, and thus the control is performed in a direction in which the lowest voltage of the driving signal COM-A decreases.

The same operation as that of correction (1) is repeated from correction (2) to correction (8). That is, the operation of correcting the voltage VLdac according to the data Do is repeated a total of eight times. Thus, the voltage VLdac is adjusted so that the average value of the voltages of the signal Aa becomes the target 2.442.

Even in the low-side correction mode, the voltage is considered not to be switched after correction (5). However, a margin is set after correction (5), as in the high-side correction mode.

The DAC 800 independently adjust the voltage of the signal Va to be output on the high side and the low side so that the waveform approaches a target waveform. Therefore, even when the characteristics of the lowpass filter vary, the variation can be absorbed and the ejection of the liquid droplets can be controlled with high accuracy.

Here, the fact that the characteristics of the lowpass filter may vary means that an element included in the lowpass filter, particularly, a low-cost element such as the inductor L2 of which the inductance varies, can be used. Accordingly, the control of the ejection of the liquid droplets with high accuracy in the DAC 800 can be realized at low cost.

The upper limit and the lower limit of the voltage of the signal Aa output by the above-described DAC 800 are configured to be defined by the voltage VHdac and the voltage VLdac, respectively. However, when high ejection accuracy is not necessary, the upper limit and the lower limit may be configured to be defined by only of these voltages. Voltages other than the upper limit and the lower limit may be adjusted. When high ejection accuracy is necessary, an intermediate voltage, for example, a voltage corresponding to the voltage Vc of the driving signal COM-A (COM-B), may be set as an adjustment criterion in addition to the upper limit and the lower limit.

The side generating the driving signal COM-A in the driving circuit 50 has been described as an example, but the side generating the driving signal COM-B has the same configuration. However, the highest voltage and the lowest voltage of the driving signal COM-B are different from those of the driving signal COM-A. Therefore, in the correction mode, an operation suitable for the highest voltage of the driving signal COM-B is performed in the high-side correction mode and an operation suitable for the highest voltage of the driving signal COM-B is performed in the low-side correction mode.

In the above description, the variation in the inductance of the inductor L2 has been exemplified as the reason why the voltage of the driving signal COM-A (the signal Va) does not become the target value, but other various reasons can be exemplified.

For example, for a plurality of kinds of the printing apparatuses 1, the driving circuit 50 is common, but the number of nozzles in the head unit 20 differs in some cases. When the number of nozzles differs, a total capacity value of the piezoelectric elements 60 to be driven differs. In the DAC 800 of the driving circuit 50 according to the embodiment, the voltage (criterion voltage) serving as a criterion is changed step by step in the correction mode so that the voltage of the signal Va based on the signal Vf obtained by the feedback of the driving signal COM-A becomes the target value. Therefore, the designed waveform of the driving signal COM-A can be formed without dependency on the number of nozzles or the like, and thus adjustment on the downstream side of the DAC 800 is not necessary.

Therefore, as a result, the voltages VHdac and VLdac in the DAC 800 are changed according to the number of piezoelectric elements.

The characteristics of the inductor L2, particularly, the inductance, is changed according to temperature although related to the inductor L2 of the lowpass filter smoothing the amplified modulated signal. In particular, when the number of nozzles 651 is plural, a relatively large current flows in the inductor L2, and thus temperature can be said to easily increase in some situations. In the DAC 800, the voltage serving as the criterion is changed step by step so that the voltage of the signal Va becomes the target value even when the temperature of the inductor L2 is changed, the inductance is changed, and thus the characteristics of the lowpass filter are changed. Therefore, even when the temperature of the inductor L2 is changed, the designed waveform of the driving signal COM-A (COM-B) can be formed, and thus the adjustment on the downstream side of the DAC 800 is not necessary.

Therefore, as a result, the voltages VHdac and VLdac in the DAC 800 are changed according to the temperature of the inductor L2.

Some heat is generated in the transistors M3 and M4 even in the class D amplification although the heat is less than in the AB class amplification or the like. In a configuration in which the DAC 800 of the present specification is not adopted, the characteristics of the transistors M3 and M4 are also changed when the temperature (the assumed temperature) assumed in the transistors M3 and M4 is changed. Therefore, when an assumed temperature is changed, the driving signal COM-A which is an output is also changed with respect to the waveform of the target signal Aa, and thus the ejection of the liquid droplets may not be controlled with high accuracy.

In contrast, in the configuration in which the DAC 800 of the present specification is adopted, the voltage (criterion voltage) serving as the criterion is changed step by step so that the voltage of the signal Va based on the feedback signal of the driving signal COM-A becomes the target value even when the temperature of the transistors M3 and M4 is changed. Therefore, the designed waveform of the driving signal COM-A can be formed without dependency on the assumed temperature of the transistors M3 and M4.

The characteristics of the transistors M3 and M4 are affected not only by the temperature but also a driving time.

The assumed temperature mentioned here includes not only the directly detectable temperature but also a temperature indirectly calculated based on a driving time of the transistor, the number of times a liquid is ejected from the nozzles based on a factor such as a current amount flowing in a specific portion.

A driving time can be exemplified as the factor changing the characteristics of the transistors M3 and M4 as well as the assumed temperature.

Accordingly, as a result, the voltages VHdac and VLdac in the DAC 800 are changed according to the assumed temperature and the driving time of the transistors M3 and M4.

The invention is not limited to the above-described embodiment, but may be modified in various ways to be described below, for example. Further, one or a plurality of modification aspects to be described below can be appropriately combined.

In the embodiment, the configuration has been described in which the driving circuit 50 generates the modulated signal Ms and feeds back the driving signal COM-A (COM-B) smoothed from the amplified modulated signal by the lowpass filter, but the modulated signal Ms itself may be feedback. For example, although not particularly illustrated, a configuration may be realized in which an error between the modulated signal Ms and an input signal As is calculated, a signal delayed by the error and the target signal Aa are subjected to addition or subtraction, and the result is input to the comparator 520.

The amplified modulated signal appearing at the connection point (the pin Sw) of the transistors M3 and M4 has different logic amplitudes from the modulated signal Ms. Therefore, for example, the amplified modulated signal may be attenuated, and then may be feedback as in the modulated signal Ms.

In the embodiment, the configuration has been described in which the driving signals COM-A and COM-B of two systems separately generated by the two driving circuits 50 are selected (or not selected) by the selection unit 230 and the selected driving signal is supplied to one end of each piezoelectric element 60. However, for example, a configuration may be realized in which, for example, four trapezoid waveforms are repeated in a driving signal of one system and any one or a plurality of the trapezoid waveforms are combined according to the sizes of dots defined by the data signal Data to be supplied to one end of each piezoelectric element 60.

What is claimed is:

1. A liquid ejecting apparatus comprising:

a modulation circuit that performs pulse modulation on an original signal to generate a modulated signal;

a first gate driver that generates a first gate signal according to the modulated signal;

a second gate driver that generates a second gate signal different from the first gate signal according to the modulated signal;

a pair of transistors that include a first transistor of which an ON or OFF state is controlled according to the first gate signal and a second transistor of which an ON or OFF state is controlled according to the second gate signal and generate an amplified modulated signal amplified from the modulated signal by controlling the ON or OFF states of the first and second transistors;

a lowpass filter that smoothes the amplified modulated signal to generate a driving signal;

an AD converter that performs AD conversion on a voltage based on the driving signal;

a piezoelectric element that is displaced when the driving signal is applied;

a cavity of which an internal volume is changed by the displacement of the piezoelectric element; and a nozzle that is installed to eject a liquid inside the cavity in response to the change in the internal volume of the cavity, wherein the AD converter includes at least K (where K is an integer equal to or greater than 2) capacitors and a controller that causes the K capacitors to sample voltages based on the driving signal at temporally different timings, and subsequently equalizes the voltages and outputs a result of the AD conversion based on the equalized voltage.

2. The liquid ejecting apparatus according to claim 1, wherein the controller causes one ends of the K capacitors to sample the driving signal at the temporally different timings when each of other ends of the K capacitors is maintained at a predetermined potential, and subsequently performs the equalization by releasing the maintenance of the predetermined potential at the other end and subsequently applying a criterion voltage to each one end.

3. The liquid ejection apparatus according to claim 1, wherein the voltages are sampled by successively connecting the capacitors to the voltages at the temporally different timings.

* * * * *